US012486846B2

(12) United States Patent
Matsuzaka et al.

(10) Patent No.: US 12,486,846 B2
(45) Date of Patent: Dec. 2, 2025

(54) GAS COMPRESSOR

(71) Applicant: HITACHI INDUSTRIAL EQUIPMENT SYSTEMS CO., LTD., Tokyo (JP)

(72) Inventors: Takehiro Matsuzaka, Tokyo (JP); Masahiko Takano, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 18/839,979

(22) PCT Filed: Dec. 28, 2022

(86) PCT No.: PCT/JP2022/048511
§ 371 (c)(1),
(2) Date: Aug. 20, 2024

(87) PCT Pub. No.: WO2023/171099
PCT Pub. Date: Sep. 14, 2023

(65) Prior Publication Data

US 2025/0180019 A1 Jun. 5, 2025

(30) Foreign Application Priority Data

Mar. 7, 2022 (JP) ..... 2022-034363

(51) Int. Cl.
*F04C 18/16* (2006.01)
*F04C 29/04* (2006.01)

(52) U.S. Cl.
CPC ..... *F04C 18/16* (2013.01); *F04C 29/04* (2013.01)

(58) Field of Classification Search
CPC ..... F04C 18/16; F04C 29/04; F04C 29/02; F04C 29/021; F04C 29/028; F04C 2240/30; F04C 2270/19; F04C 2270/20
See application file for complete search history.

(56) References Cited

U.S. PATENT DOCUMENTS 10,001,124 B2 * 6/2018 Takano ..... F25B 43/02
11,047,390 B2 * 6/2021 Kotani ..... F04C 18/16
(Continued)

FOREIGN PATENT DOCUMENTS

JP 2012-067743 A 4/2012
JP 2014-145273 A 8/2014
(Continued)

OTHER PUBLICATIONS

International Search Report of PCT/JP2022/048511 dated Mar. 14, 2023.
(Continued)

*Primary Examiner* — Dapinder Singh
(74) *Attorney, Agent, or Firm* — MATTINGLY & MALUR, PC

(57) ABSTRACT

A gas compressor is capable of adjusting a temperature of a heat recovery liquid discharged from a waste-heat-recovery heat exchanger to a desired temperature at a low cost without providing a temperature adjusting valve in a passage of the heat recovery liquid. The gas compressor includes a heat exchange liquid temperature sensor for detecting the temperature Tw2 of a heat exchange liquid discharged from a waste-heat-recovery heat exchanger, and a passage that allows at least part of a high-temperature fluid cooled by an air-cooled cooler to flow therethrough into a compressor. A controller has a heat exchange liquid temperature adjusting function to control the rotational speed of a cooling fan such that the temperature Tw2 detected by the heat exchange
(Continued)

liquid temperature sensor gets closer to a predetermined target heat exchange liquid temperature Tw2*t*.

9 Claims, 15 Drawing Sheets

(56) References Cited

U.S. PATENT DOCUMENTS

| | | | | |
|---|---|---|---|---|
| 11,821,657 | B2 * | 11/2023 | Yamamoto | F04B 41/00 |
| 2013/0156548 | A1 * | 6/2013 | Takano | F25B 31/004 415/114 |
| 2015/0362212 | A1 * | 12/2015 | Yamamoto | F04B 53/08 122/15.1 |

FOREIGN PATENT DOCUMENTS

| | | | |
|---|---|---|---|
| JP | 2016-048142 | A | 4/2016 |
| JP | 2016-191386 | A | 11/2016 |
| JP | 2021-088938 | A | 6/2021 |

OTHER PUBLICATIONS

International Preliminary Report on Patentability received in corresponding International Application No. PCT/JP2022/048511 dated Sep. 19, 2024.

* cited by examiner

GAS COMPRESSOR

TECHNICAL FIELD

The present invention relates to a gas compressor.

BACKGROUND ART

Generally, there has been known a gas compressor with a waste heat recovery function or a waste heat recovery system for recovering heat from a high-temperature compressed gas discharged from a gas compressor that compresses a gas such as air or a lubricating oil that has attained a high temperature after being injected into a gas compressor to lubricate mechanism elements in the gas compressor and to increase a gas compression efficiency, and extracting the recovered heat in the form of hot water. For example, Patent Document 1 discloses an oil-cooled gas compressor equipped with a waste heat recovery apparatus, i.e., an oil-cooled gas compressor with which a waste heat recovery apparatus is combined and in which a lubricating oil is positively injected into a working space in a compressor main body in order to lubricate mechanism members in the gas compressor and to increase a gas compression efficiency.

PRIOR ART DOCUMENT

Patent Document

Patent Document 1: JP-2016-191386-A

SUMMARY OF THE INVENTION

Problems to be Solved by the Invention

Where hot water is extracted by recovering waste heat from the compressed air and the lubricating oil, higher hot-water temperatures find easier use because of a wider range of applications in which they can effectively be used. Patent Document 1 that discloses the oil-cooled gas compressor equipped with the waste heat recovery apparatus describes a control method that controls the rotational speed of a fan motor through an inverter in such a manner that the difference between a preset target temperature for the discharged compressed air and the present temperature of the discharged compressed air becomes small to thereby keep the temperature of the lubricating oil injected into the compressor main body within an appropriate range. However, there is nothing, in the Patent Document 1, that refers to controlling the operation of some rotors and valves to increase hot-water temperatures.

The present invention has been made in view of the above problems. It is an object of the present invention to provide a gas compressor that is capable of adjusting the temperature of a heat recovery liquid, which is discharged from a waste-heat-recovery heat exchanger, to a desired temperature at a low cost without providing a temperature adjusting valve in the passage of the heat recovery liquid.

Means for Solving the Problems

In order to achieve the above object, there is provided, according to the present invention, a gas compressor including a compressor main body for sucking in a gas, compressing the sucked gas, and discharging the compressed gas, a waste-heat-recovery heat exchanger for performing a heat exchange between at least part of a high-temperature fluid discharged from the compressor main body and a heat exchange liquid as a low-temperature fluid, an air-cooled cooler for cooling the high-temperature fluid, a cooling fan for delivering air to the air-cooled cooler, a controller for controlling a rotational speed of the cooling fan, and a discharged gas temperature sensor for detecting a discharged gas temperature representing a temperature of the compressed gas discharged from the compressor main body. Further, the gas compressor includes a heat exchange liquid temperature sensor for detecting a temperature of the heat exchange liquid discharged from the waste-heat-recovery heat exchanger, and a passage that allows at least part of the high-temperature fluid cooled by the air-cooled cooler to flow therethrough into the compressor main body, and the controller has a heat exchange liquid temperature adjusting function to control the rotational speed of the cooling fan such that the temperature detected by the heat exchange liquid temperature sensor gets closer to a predetermined target heat exchange liquid temperature.

According to the present invention configured as above, the degree to which the high-temperature fluid flowing into the compressor main body is cooled is adjusted by the cooling fan, making it possible to adjust the temperature of the high-temperature fluid flowing into the waste-heat-recovery heat exchanger. This makes it possible to adjust the temperature of a heat recovery liquid discharged from the waste-heat-recovery heat exchanger to a desired temperature at a low cost without providing a temperature adjusting valve in the passage of the heat recovery liquid.

Advantages of the Invention

The gas compressor according to the present invention makes it possible to adjust the temperature of a heat recovery liquid discharged from a waste-heat-recovery heat exchanger to a desired temperature at a low cost without providing a temperature adjusting valve in the passage of the heat recovery liquid.

MODES FOR CARRYING OUT THE INVENTION

Figure 1:
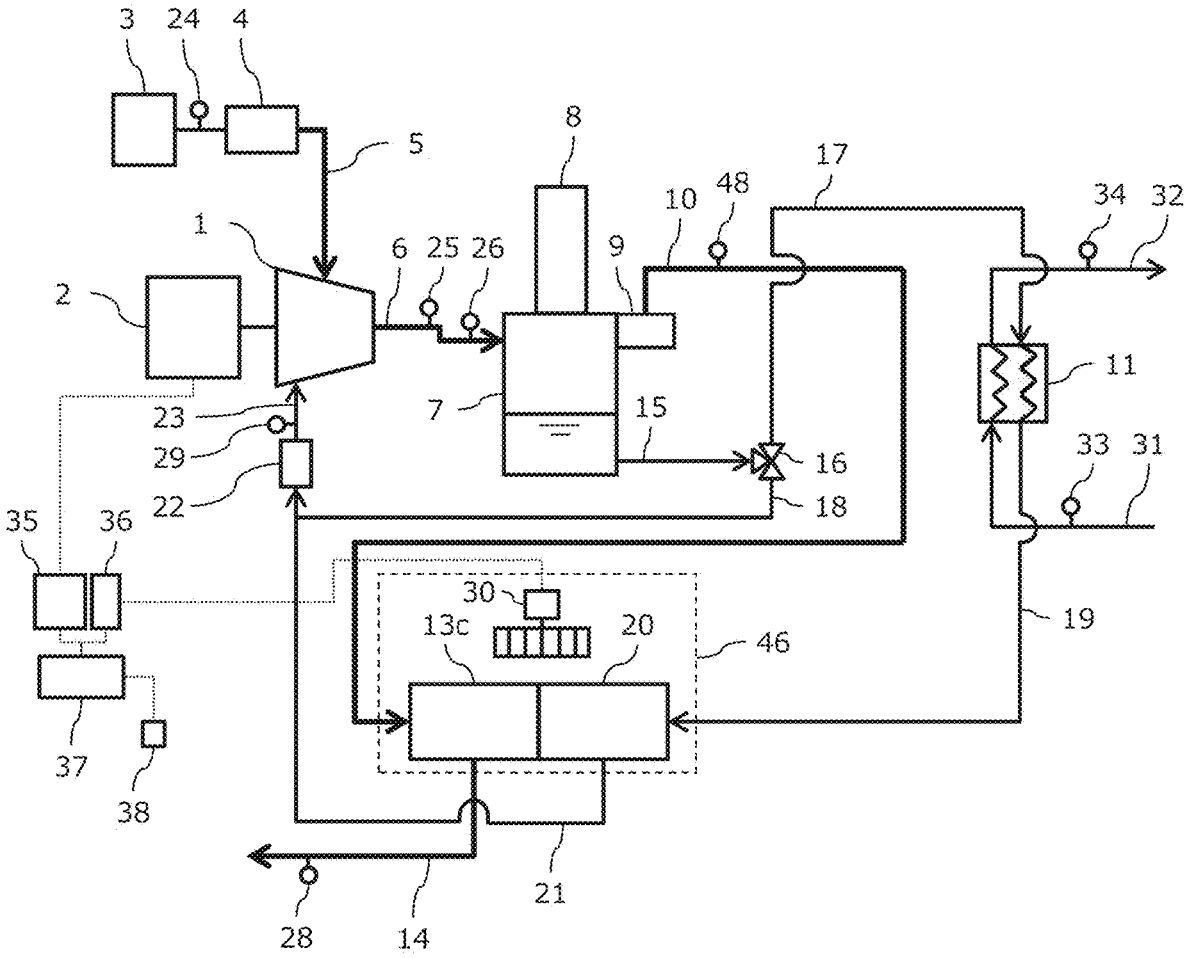
FIG. 1 is a schematic diagram illustrating a general configuration a gas compressor according to a first embodiment of the present invention.

Embodiments of the present invention will be described hereinbelow with reference to the drawings. In the drawings, equivalent constituent elements are denoted by identical reference characters and their redundant description will be omitted.

First Embodiment

FIG. 1 is a schematic diagram illustrating a general configuration of a gas compressor according to a first embodiment of the present invention. The gas compressor according to the present embodiment is an oil-fed air compressor. A compressor main body 1 includes a pair of male and female screw rotors that are held in mesh with each other while in contact with each other and define a working space for compressing air between themselves and the inner surface of a casing of the compressor main body 1. When in loaded operation that supplies compressed air to demanders, the compressor main body 1 is driven by a main motor 2 and an intake valve 4 is opened to suck in ambient air through an intake filter 3 into the compressor main body 1. The sucked air is filtered by the intake filter 3 and goes through the intake valve 4 into the compressor main body 1 in which the air is compressed to a predetermined pressure as the volume of the working space in the compressor main body 1 is reduced with rotation of the screw rotors, after which the compressed air is discharged. A lubricating oil is positively injected into the compressor main body 1 for the purposes of lubricating the screw rotors and mechanism elements such as bearings, not depicted, cooling the heat of the compressed air in the working space, and restraining the air from flowing back via minute gaps in the compressor main body 1. The compressed air discharged from the compressor main body 1 flows through a discharged air passage 6 into a primary oil separator 7 that separates much lubricating oil mixed with the compressed air and stores the separated lubricating oil in a lower portion thereof. The compressed air from which the oil has been primarily separated flows into a secondary oil separator 8, where most of minute oil droplets and oil mist having been remained in the compressed air is separated. Thereafter, the compressed air from which the oil has been secondarily separated flows via a pressure-regulating check valve 9 and a discharged air passage 10 into an aftercooler 13*c*. The aftercooler 13*c* is an air-cooled cooler that cools the compressed air with cooling air produced by a cooling fan 30. The compressed air that has been finally cooled by the aftercooler 13*c* is supplied through a discharged air passage 14 to the compressed-air demanders.

The lubricating oil injected into the compressor main body 1 is discharged together with the compressed air and separated therefrom by the primary oil separator 7 and the secondary oil separator 8, and is thereafter temporarily stored in the lower portion of the primary oil separator 7. Under the pressure in the primary oil separator 7, the lubricating oil is delivered in its entirety to an oil passage 17 or an oil bypass passage 18, or distributed at respective flow rates to the oil passage 17 and the oil bypass passage 18, via an oil passage 15 and a temperature control valve 16. The temperature control valve 16 is of a mechanical structure capable of distributing respective flow rates to two directions at its outlet side when a medium sealed therein is expanded depending on the temperature of the lubricating oil. If the lubricating oil temperature is lower than a predetermined temperature, then the lubricating oil flows in its entirety into the oil bypass passage 18 in bypassing relation to a waste-heat-recovery heat exchanger 11 and an oil cooler 20 to be described later. Therefore, the lubricating oil circulates between the compressor main body 1, the primary oil separator 7, and the oil bypass passage 18, so that the lubricating oil temperature is quickly increased to prevent the saturated compressed air from being cooled by a cold lubricating oil and hence to prevent a lot of condensed water from being produced in the primary oil separator 7, and prevent the oil from becoming so high in viscosity that power consumption increases. If, on the other hand, the lubricating oil temperature is higher than the predetermined temperature, then the lubricating oil flows in its entirety via the oil passage 17 into an oil passage in the waste-heat-recovery heat exchanger 11, heating water as a low-temperature fluid therein to perform waste heat recovery, after which the lubricating oil flows via an oil passage 19 into the oil cooler 20. The oil cooler 20 is an air-cooled cooler as with the aftercooler 13*c*. After being cooled by cooling air in the oil cooler 20, the lubricating oil is injected through an oil passage 21 and an oil filter 22 into the compressor main body 1 again. The cooling fan 30, the after cooler 13*c*, and the oil cooler 20 are housed in a fan duct 46, or the fan duct 46 has an opening connected to air passage portions of the aftercooler 13*c* and the oil cooler 20.

Water flows as the low-temperature fluid from a water supply source via a water supply passage 31 into a water passage in the waste-heat-recovery heat exchanger 11. The water is heated by the high-temperature lubricating oil that flows as a high-temperature fluid in the waste-heat-recovery heat exchanger 11, and then flows into a water supply passage 32 from which it is supplied to hot-water demanders. In this manner, the heat of the lubricating oil as the high-temperature fluid can be extracted in the form of hot water. The extracted hot water can effectively be used in various applications such as preheating or keeping hot water to be supplied to a boiler, thereby reducing fuel and electric power that have heretofore been required to produce hot water. The temperature of the water supplied from the water supply source is detected as a water inlet temperature Tw1 by a water inlet temperature sensor 33 provided on a water supply passage 31 extending upstream of the inlet of the water passage in the waste-heat-recovery heat exchanger 11, and the temperature of the hot water heated by and extracted from the waste-heat-recovery heat exchanger 11 is detected as a water outlet temperature Tw2 by a water outlet temperature sensor 34 provided on the water supply passage 32 extending downstream of the outlet of the water passage in the waste-heat-recovery heat exchanger 11.

A main motor 2 of the present compressor can be controlled in its rotational speed by a frequency output from a main motor inverter 35. The rotational speed of the main motor 2 is controlled in such a manner that a unit outlet discharged air pressure Pd detected by a unit outlet discharged air pressure sensor 28 provided on the discharged air passage 14 is equal to a predetermined set pressure. When the amount of compressed air that is used is reduced until the unit outlet discharged air pressure Pd exceeds the predetermined set pressure, the present compressor switches from the loaded operation thus far to unloaded operation. At this time, the main motor inverter 35 outputs a lower-limit frequency to decelerate the main motor 2 to a lower-limit rotational speed, and the intake valve 4 is closed, allowing air to be sucked in only via minute gaps formed between the valve casing of the intake valve 4 and the valve body thereof, so that the amount of sucked air is reduced to thereby reduce the power consumed by the compressor. During the unloaded operation, the pressure-regulating check valve 9 operates to keep a minimum pressure required to supply the lubricating oil to the compressor main body 1 on the upstream side of the pressure-regulating check valve 9, i.e., upstream side of the primary oil separator 7.

The cooling fan 30 can be controlled in its rotational speed by a frequency output from a cooling fan inverter 36. The cooling fan inverter 36 varies its output frequency so as to bring the value of a discharged air temperature Td1, which is detected by a discharged air temperature sensor 25 provided on the discharged air passage 6, in the vicinity of a predetermined temperature, thereby controlling the rotational speed of the cooling fan 30. A main control board 37 combined with the main motor inverter 35, the cooling fan inverter 36, and other sensors and valves controls the compressor in its entirety.

The discharged air temperature Td1 and the temperature of the lubricating oil are essentially identical to each other. Specifically, since the lubricating oil is supplied to a working chamber in the compressor main body 1 and cools the heat of compression generated in a process of compressing air, the temperature of the lubricating oil discharged together with compressed air from the compressor main body 1 is essentially equal to the discharged air temperature Td1. In the oil-cooled compressor, the discharged air temperature Td1 can be substituted for the temperature of the lubricating oil obtained after flowing out of the compressor main body 1 and before exchanging heat with another fluid.

Figure 3:
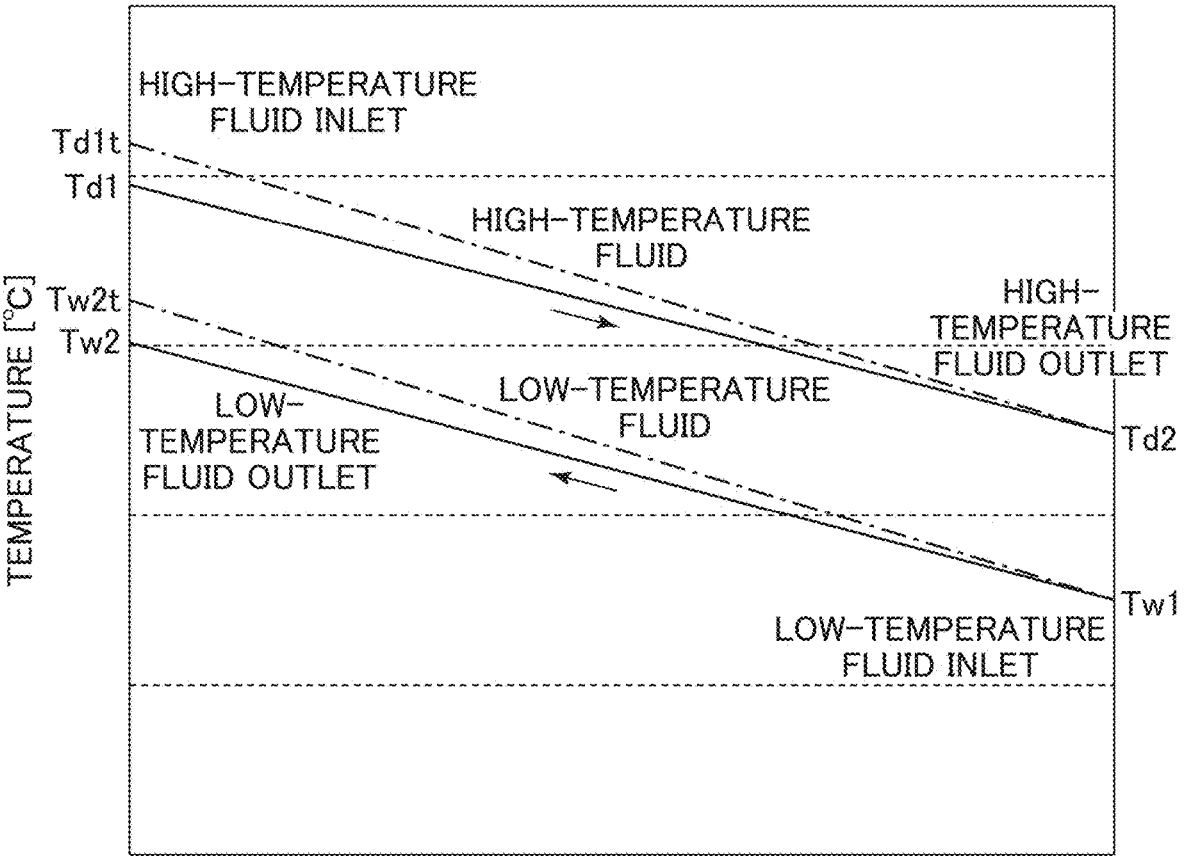
FIG. 3 is a diagram illustrating the inlet and outlet temperatures of a high-temperature fluid and a low-temperature fluid in a waste-heat-recovery heat exchanger according to the first embodiment of the present invention.

A process of extracting desired hot water from a low-temperature fluid passage outlet of the waste-heat-recovery heat exchanger 11 will be described below. FIG. 3 is a diagram illustrating the inlet and outlet temperatures of a high-temperature fluid (lubricating oil) and a low-temperature fluid (water) in the waste-heat-recovery heat exchanger 11 according to the present embodiment. The waste-heat-recovery heat exchanger 11 is a counterflow-type heat exchanger, and a logarithmic average temperature difference ΔTm is generally expressed by the following equation:

$$\Delta Tm = ((Td1 - Tw2) - (Td2 - Tw1))/\mathrm{LN}\big((Td1 - Tw2)/(Td2 - Tw1)\big)$$

Providing the rate at which water flows into the waste-heat-recovery heat exchanger 11 and the water inlet temperature Tw1 are constant, in order to increase the water outlet temperature Tw2 of the hot water flowing out after heated by the waste-heat-recovery heat exchanger 11 up to a target water outlet temperature Tw2*t* (assuming that Tw2<Tw2*t*), the lubricating oil temperature on the high temperature side may be increased. Inasmuch as the lubricating oil temperature is the same as the discharged air temperature Td1 in the oil-cooled compressor, the discharged air temperature Td1 is increased to a target discharged air temperature Td1*t* (assuming that Td1<Td1*t*). At this time, if the target discharged air temperature Td1*t* is determined so as to keep logarithmic average temperature difference ΔTm constant in order to obtain the target water outlet temperature Tw2*t*, the characteristics illustrated in FIG. 3 are obtained.

Figure 4:
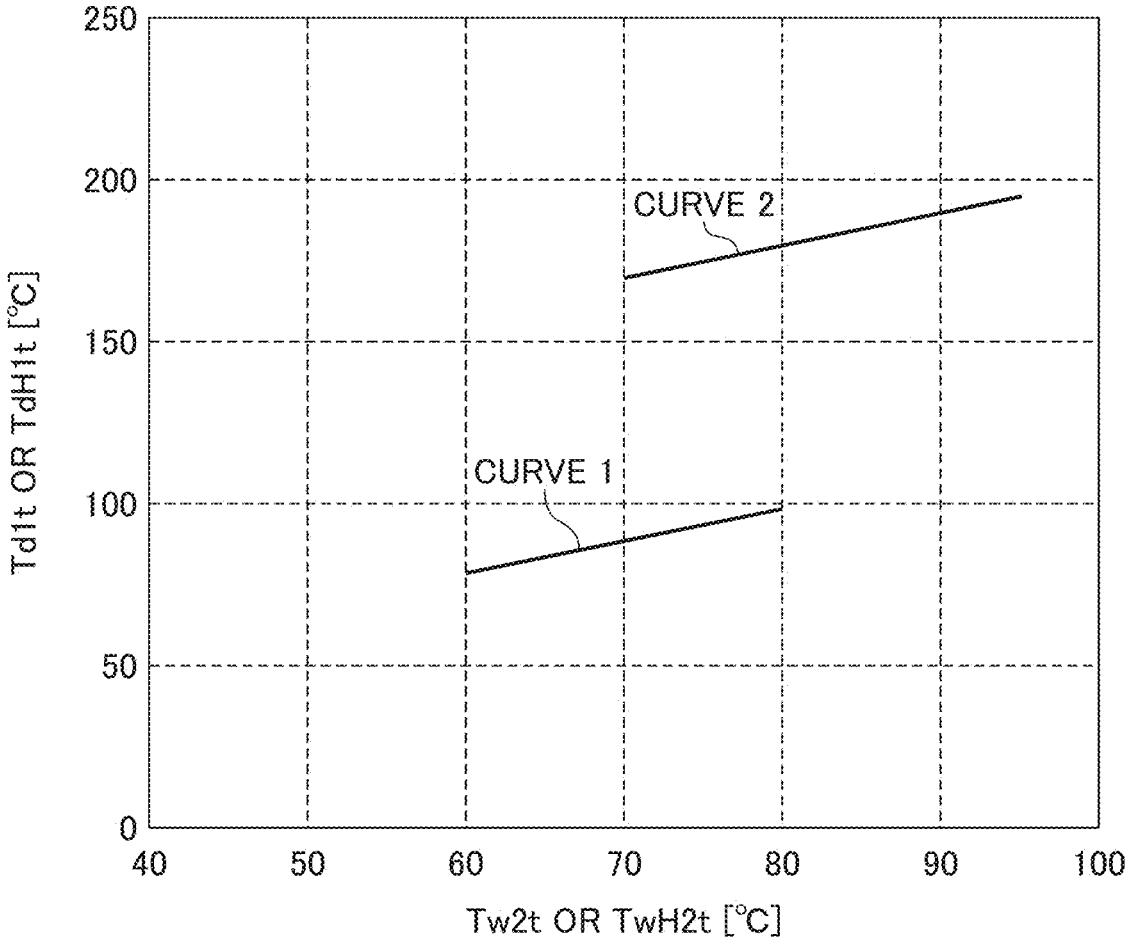
FIG. 4 is a diagram illustrating characteristic curves that represent the relationship between the target water outlet temperature or a target high-pressure stage water outlet temperature and a target discharged air temperature or a target high-pressure stage discharged air temperature according to the first embodiment of the present invention.

By calculating the relationship between target water outlet temperatures Tw2*t* and target discharged air temperatures Td1*t* with respect to a heat exchanger that has been adopted and preparing a characteristic curve, when the operator sets a desired target water outlet temperature Tw2*t*, a corresponding target discharged air temperature Td1*t* can easily be obtained. A curve 1 illustrated in FIG. 4 is a characteristic curve representing the relationship between the target water outlet temperature Tw2*t* and the target discharged air temperature Td1*t* according to the present embodiment. When a desired target water outlet temperature Tw2*t* is set, a cooling fan inverter output frequency Ff may be feedback-controlled to adjust the discharged air temperature Td1, such that a target discharged air temperature Td1*t* corresponding to the target water outlet temperature Tw2*t* is obtained.

The gas compressor according to the present embodiment has a hot water priority mode (heat recovery liquid temperature adjusting function) as an operation mode for controlling the rotational speed of the cooling fan 30 such that the water outlet temperature Tw2 is brought in the vicinity of the temperature (target water outlet temperature Tw2*t*) of hot water to be supplied to demanders. The hot water priority mode may be desirably switched between being effective or ineffective by the operator of the compressor via an input and display device 38 (switching indicating device).

Figure 2:
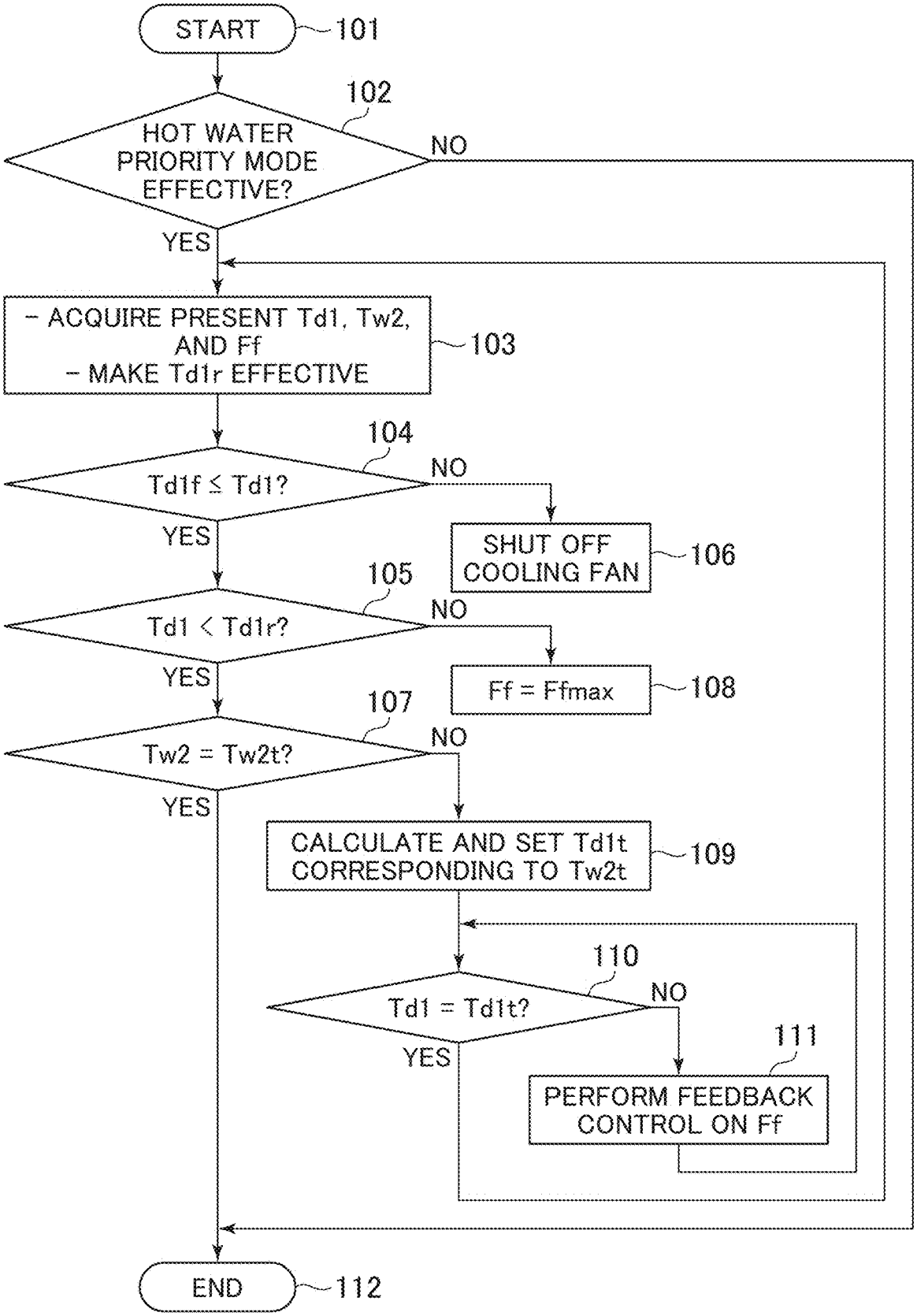
FIG. 2 is a flowchart of a control sequence for adjusting a water outlet temperature to a target water outlet temperature in the gas compressor according to the first embodiment of the present invention.

FIG. 2 is a flowchart of a control sequence in a case where the hot water priority mode is set to be effective. Step 101 represents a starting point of a control process according to the present embodiment. Step 102 refers to a process of determining whether the hot water priority mode is effective or not. If effective, then control goes to step 103. If not effective, then control goes to step 112, ending the present flowchart. In step 103, the discharged air temperature Td1, the water outlet temperature Tw2, and the cooling fan inverter output frequency Ff at present are acquired. Moreover, a hot-water-priority-mode discharged air upper-limit temperature Td1*r*, which is set to be slightly lower than a discharged air alarm temperature Td1A at the time of the hot water priority mode being ineffective, is made effective. Then, in step 104, it is determined whether or not the discharged air temperature Td1 is equal to or higher than a fan-control-start discharged air temperature Td1*f*. If Td1$f$≤Td1 is satisfied, then control goes to step 105. If Td1$f$>Td1, then control goes to step 106 in which the cooling fan is shut off to prevent the temperature of the lubricating oil from becoming too low. Step 105 refers to a process of determining whether or not the discharged air temperature Td1 is lower than the hot water priority mode discharged air upper-limit temperature Td1$r$. If Td1<Td1$r$ is satisfied, then control goes to step 107. If Td1$r$≤Td1, then since the discharged air temperature Td1 gets closer to the discharged air alarm temperature Td1A, the cooling fan inverter output frequency Ff is set to a cooling fan inverter maximum output frequency Ffma, operating the cooling fan at full speed to reduce the discharged air temperature Td1 quickly. Then, step 107 refers to a process of determining whether or not the water outlet temperature Tw2 is equal to the target water outlet temperature Tw2$t$. If Tw2=Tw2$t$ is satisfied, then control goes to step 112, ending the present flowchart. If Tw2=Tw2$t$ is not satisfied, then control goes to step 109. Steps 109 to 111 refer to a process of controlling the water outlet temperature Tw2 to be equal to the target water outlet temperature Tw2$t$. First, in step 109, the target discharged air temperature Td1$t$ is calculated again. Then, it is determined whether or not the discharged air temperature Td1 is equal to the target discharged air temperature Td1$t$ calculated again in step 109. If Td1=Td1$t$ is satisfied, then control returns to immediately before step 103. If Td1=Td1$t$ is not satisfied, then control goes to step 111 in which the cooling fan inverter output frequency Ff is feedback-controlled. Steps 110 and 111 are looped until Td1=Td1$t$ becomes satisfied. If Td1=Td1$t$ is satisfied as a result of the cooling fan inverter output frequency control, then control goes back to immediately before step 103 as described above. The control sequence described above makes it possible to supply hot water where Tw2=Tw2$t$ to hot water demanders. Note that, in steps 107 and 110, the water outlet temperature Tw2 and the discharged air temperature Td1 at present may not be strictly equal to their respective target temperatures, but certain allowable ranges may be established with respect to the target temperatures. For example, a° C., b° C. may be given as allowable ranges as in (Tw2$t$−a) [° C.]≤Tw2 [° C.]≤(Tw2$t$−a) [° C.] and (Td1$t$−b) [° C.]≤Td1 [° C.]≤(Td1$t$+b) [ ° C.], thereby preventing chattering from occurring in the control flowchart. The allowable ranges a° C., b° C. may be established as desired by the operator, so that they are useful to adjust how much variations such as abrupt temperature changes in the ambient environment should be absorbed.

In step 109, a target discharged air temperature Td1$t$ corresponding to the target water outlet temperature Tw2$t$ may be determined from the characteristic curve of the waste-heat-recovery heat exchanger 11 as indicated by the curve 1 in FIG. 4. The data of the curve 1 in FIG. 4 are stored in the main control board 37, and a target discharged air temperature Td1$t$ obtained when the target water outlet temperature Tw2$t$ is input is used as an output value, and the output value is set as a target discharged air temperature in the hot water priority mode. Thereafter, in step 110, the cooling fan inverter output frequency Ff is feedback-controlled so as to cause the discharged air temperature Td1 to reach the target discharged air temperature Td1$t$, with the result that the water outlet temperature Tw2 reaches the target water outlet temperature Tw2$t$.

The above process of controlling the water outlet temperature Tw2 offers the following advantages: Heretofore, in order to adjust a hot water temperature to be extracted, it has been necessary to provide a temperature-adjusting valve on a water supply passage, which is responsible for an increase in the number of man-hours involved in its installation and the cost. Furthermore, in order to keep the hot water temperature constant, the opening of the temperature-adjusting valve is adjusted, resulting in a reduction in the flow rate and hence in a situation where hot water demanders are unable to use hot water at a constant flow rate at all times. According to the present embodiment, those problems are addressed simply by adding the water outlet temperature sensor 34 to the cooling fan 30, the cooling fan inverter 36, and the discharged air temperature sensor 25 that have been included as standard elements in the compressor, to supply hot water at a predetermined target temperature with ease and at a low cost.

Figure 5:
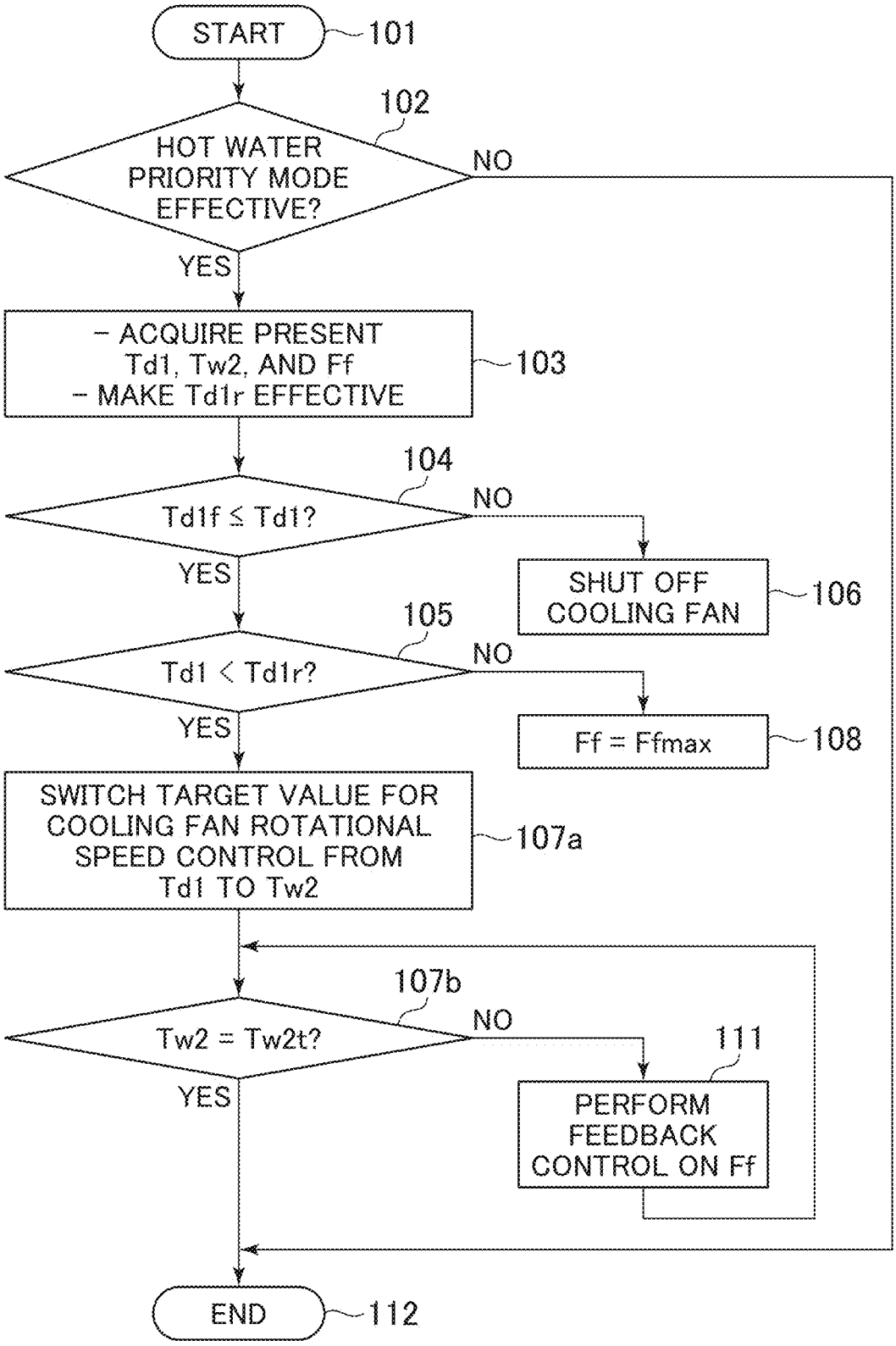
FIG. 5 is a flowchart of a modification of the control sequence for adjusting a water outlet temperature to a target water outlet temperature in the gas compressor according to the first embodiment of the present invention.

FIG. 5 is a flowchart of a control sequence according to a modification for adjusting the water outlet temperature Tw2 to the target water outlet temperature Tw2$t$. The flowchart of FIG. 5 will be described below mainly with respect to its differences from the flowchart of FIG. 2. In the flowchart of FIG. 5, if Td1<Td1$r$ is satisfied in step 105, then control goes to step 107$a$. In step 107$a$, the target value for the cooling fan rotational speed control switches from the discharged air temperature Td1 to the water outlet temperature Tw2 to be detected. Then, in step 107$b$, if Tw2=Tw2$t$ is satisfied between the water outlet temperature Tw2 and the target water outlet temperature Tw2$t$, the present flowchart is ended. If Tw2=Tw2$t$ is not satisfied, then control goes to step 111 in which the cooling fan inverter output frequency Ff is feedback-controlled until Tw2=Tw2$t$ is satisfied.

The flowchart of FIG. 5 makes it possible to control the water outlet temperature Tw2 more directly to obtain the target water outlet temperature Tw2$t$ with ease than the flowchart of FIG. 2.

An oil separator outlet air temperature sensor 48 is provided on the discharged air passage 10 to detect an oil separator outlet air temperature Tdsp. The oil separator outlet air temperature sensor 48 is provided mainly for the purpose of prompting the operator to replace the secondary oil separator 8 or the lubricating oil in a case where the discharged air temperature has reached a predetermined temperature or higher due to the heat generated when oil mist or oil droplets trapped within the secondary oil separator 8 are oxidized over time. Normally, the oil separator outlet air temperature Tdsp and the discharged air temperature Td1 are essentially equal to each other, and the oil separator outlet air temperature Tdsp may be used instead of the discharged air temperature Td1 in the flowchart of FIG. 2.

Summary

According to the present embodiment, the gas compressor includes the compressor main body 1 that sucks in a gas, compresses the gas, and discharges the compressed gas, the waste-heat-recovery heat exchanger 11 that performs a heat exchange between at least part (lubricating oil) of a high-temperature fluid (compressed air and lubricating oil) discharged from the compressor main body 1 and a heat exchange liquid as a low-temperature fluid, the air-cooled coolers 13$c$ and 20 that cool the high-temperature fluid, the cooling fan 30 that supplies air to the air-cooled coolers 13$c$ and 20, the controller 37 that controls the rotational speed of the cooling fan 30, and the discharged gas temperature sensor 25 that detects the discharged gas temperature as the temperature of the compressed gas discharged from the compressor main body 1. Further, the gas compressor includes the heat exchange liquid temperature sensor 34 that detects the temperature of the heat exchange liquid discharged from the waste-heat-recovery heat exchanger 11, and the passage (oil passage 21) that allows the at least part (lubricating oil) of the high-temperature fluid (compressed air and lubricating oil) cooled by the air-cooled coolers 13*c* and 20 to flow therethrough into the compressor main body 1. Furthermore, the controller 37 has a heat exchange liquid temperature adjusting function to control the rotational speed of the cooling fan 30 such that the temperature Tw2 detected by the heat exchange liquid temperature sensor 34 gets closer to the predetermined target heat exchange liquid temperature Tw2*t*.

According to the present embodiment configured as described above, the degree to which the high-temperature fluid (lubricating oil) flowing into the compressor main body 1 is cooled is adjusted by the cooling fan 30, making it possible to adjust the temperature of the high-temperature fluid (lubricating oil) flowing into the waste-heat-recovery heat exchanger 11. This makes it possible to adjust the temperature Tw2 of the heat recovery liquid discharged from the waste-heat-recovery heat exchanger 11 to the desired temperature Tw21 at a low cost without providing a temperature adjusting valve in the passage of the heat recovery liquid.

Furthermore, the controller 37 according to the present embodiment stores therein the correlative relationship (the curve 1 illustrated in FIG. 4) between the temperature Tw2 of the heat exchange liquid discharged from the waste-heat-recovery heat exchanger 11 and the temperature Td1 of the compressed gas discharged from the compressor main body 1, establishes, as the target discharged gas temperature Td1*t*, the discharged gas temperature Td1 corresponding to the temperature Tw2 of the heat exchange liquid that agrees with the predetermined temperature, and controls the rotational speed of the cooling fan 30 such that the temperature detected by the discharged gas temperature sensor 25 gets closer to the target discharged gas temperature Td1*t*. This makes it possible to adjust the temperature Tw2 of the heat exchange liquid based on the discharged gas temperature Td1.

The gas compressor according to the present embodiment includes the switching indicating device 38 for indicating whether the heat recovery liquid temperature adjusting function is to be made effective or ineffective. If the switching indicating device 38 indicates that the heat recovery liquid temperature adjusting function be made effective, then the controller 37 controls the rotational speed of the cooling fan 30 such that the temperature Tw2 detected by the heat exchange liquid temperature sensor 34 gets closer to the predetermined target heat exchange liquid temperature Tw2*t*. If the switching indicating device 38 indicates that the heat recovery liquid temperature adjusting function be made ineffective, then the controller 37 controls the rotational speed of the cooling fan 30 such that the discharged gas temperature Td1 gets closer to the predetermined target discharged gas temperature Td1*t*. This makes it possible to make the heat recovery liquid temperature adjusting function effective or ineffective as required.

Moreover, the compressor main body 1 according to the present embodiment is of the liquid-fed type in which the lubricating liquid is injected into the working chamber therein. The high-temperature fluid flowing into the waste-heat-recovery heat exchanger 11 includes the lubricating liquid (lubricating oil) discharged from the compressor main body 1. This makes it possible for the liquid-fed compressor to adjust the temperature Tw2 of the heat recovery liquid discharged from the waste-heat-recovery heat exchanger 11 to the desired temperature Tw2*t* at a low cost without providing a temperature adjusting valve or the like in the passage of the heat recovery liquid.

Second Embodiment

Figure 6:
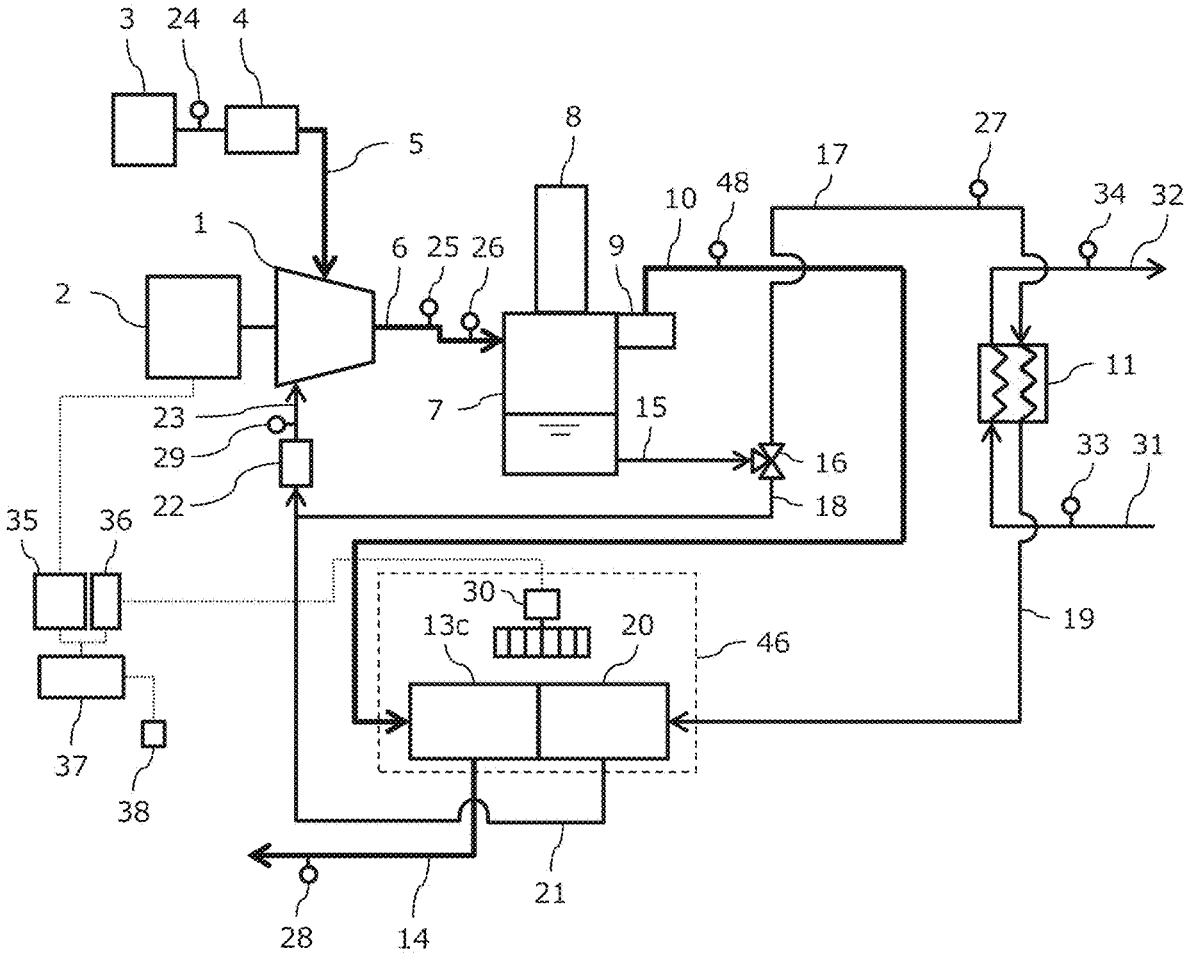
FIG. 6 is a schematic diagram illustrating a general configuration of a gas compressor according to a second embodiment of the present invention.

FIG. 6 is a schematic diagram illustrating a general configuration of a gas compressor according to a second embodiment of the present invention. The second embodiment will be described below mainly with respect to its differences from the first embodiment.

The gas compressor according to the present embodiment includes a lubricating oil inlet temperature sensor 27 provided on the oil passage 17, and uses a lubricating oil inlet temperature To1 detected by the lubricating oil inlet temperature sensor 27, instead of the discharged air temperature Td1 detected by the discharged air temperature sensor 25, to adjust the water outlet temperature tw2. The flowchart for adjusting the water outlet temperature Tw2 on the main control board 37 according to the present embodiment is similar to the flowchart (illustrated in FIG. 2) according to the first embodiment except that the discharged air temperature Td1 is replaced with the lubricating oil inlet temperature To1. Further, the curve 1 illustrated in FIG. 4 may be used as a characteristic curve that represents the relationship between the target water outlet temperature Tw2*t* and a target lubricating oil inlet temperature To1*t*, or a dedicated characteristic curve representing the relationship between the target water outlet temperature Tw2*t* and the target lubricating oil inlet temperature To1*t* may be created in advance and stored for use.

Summary

The gas compressor according to the present embodiment adjusts the temperature Tw2 of the heat exchange liquid based on the lubricating oil inlet temperature To1.

According to the present embodiment configured as described above, as with the first embodiment, it is possible to adjust the temperature of the heat recovery liquid discharged from the waste-heat-recovery heat exchanger 11 to the desired temperature at a low cost without providing a temperature adjusting valve or the like in the passage of the heat recovery liquid.

Third Embodiment

Figure 7:
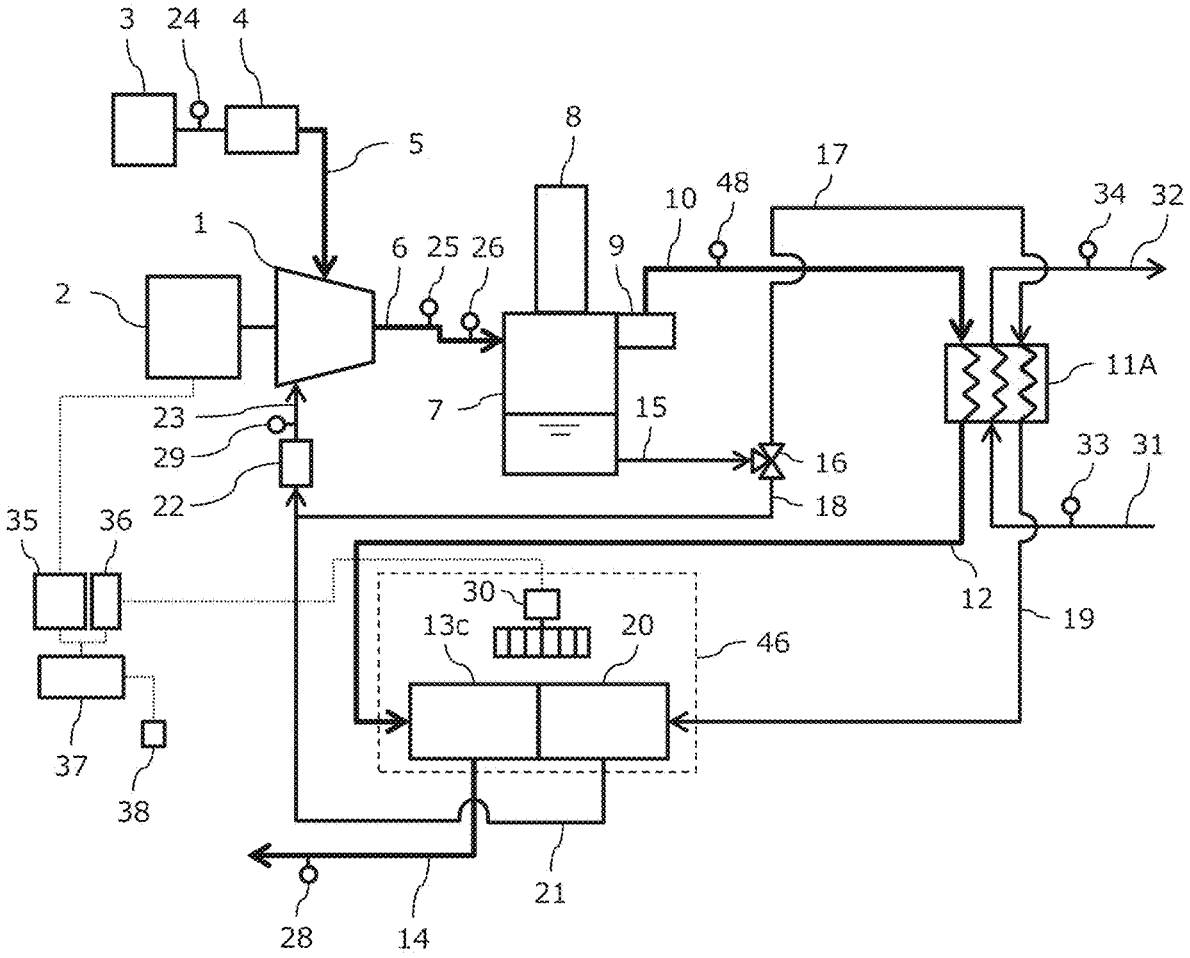
FIG. 7 is a schematic diagram illustrating a general configuration of a gas compressor according to a third embodiment of the present invention.

FIG. 7 is a schematic diagram illustrating a general configuration of a gas compressor according to a third embodiment of the present invention. The third embodiment will be described below mainly with respect to its differences from the first embodiment.

A waste-heat-recovery heat exchanger 11A according to the present embodiment includes two systems of a high-temperature fluid passage for a gas and a high-temperature fluid passage for a liquid. The compressed air after almost all oil has been separated therefrom by the primary oil separator 7 and the secondary oil separator 8 flows through the discharged air passage 10 into the gas-side high-temperature fluid passage of the waste-heat-recovery heat exchanger 11A. The lubricating oil flows through the oil passage 17 into the liquid-side high-temperature fluid passage of the waste-heat-recovery heat exchanger 11A, as is the case with FIG. 1. At this time, waste heat is recovered from the compressed air by a heat exchange performed between a high-temperature fluid, which includes the compressed air and the lubricating oil at the high temperature, and a low-temperature fluid which is water. Thereafter, the compressed air flows through the discharged air passage 12 into the aftercooler 13*c*.

Summary

The compressor main body 1 according to the present embodiment is of the liquid-fed type in which the lubricating liquid is injected into the working chamber thereinside. The high-temperature fluid flowing into the waste-heat-recovery heat exchanger 11A includes the compressed gas and lubricating liquid discharged from the compressor main body 1.

According to the present embodiment configured as described above, since a heat exchange can be performed between the high-temperature fluid, which includes both the compressed air and the oil, and the low-temperature fluid which is the wafer, the amount of heat that can be recovered can be larger than with the embodiment illustrated in FIG. 1.

Fourth Embodiment

Figure 8:
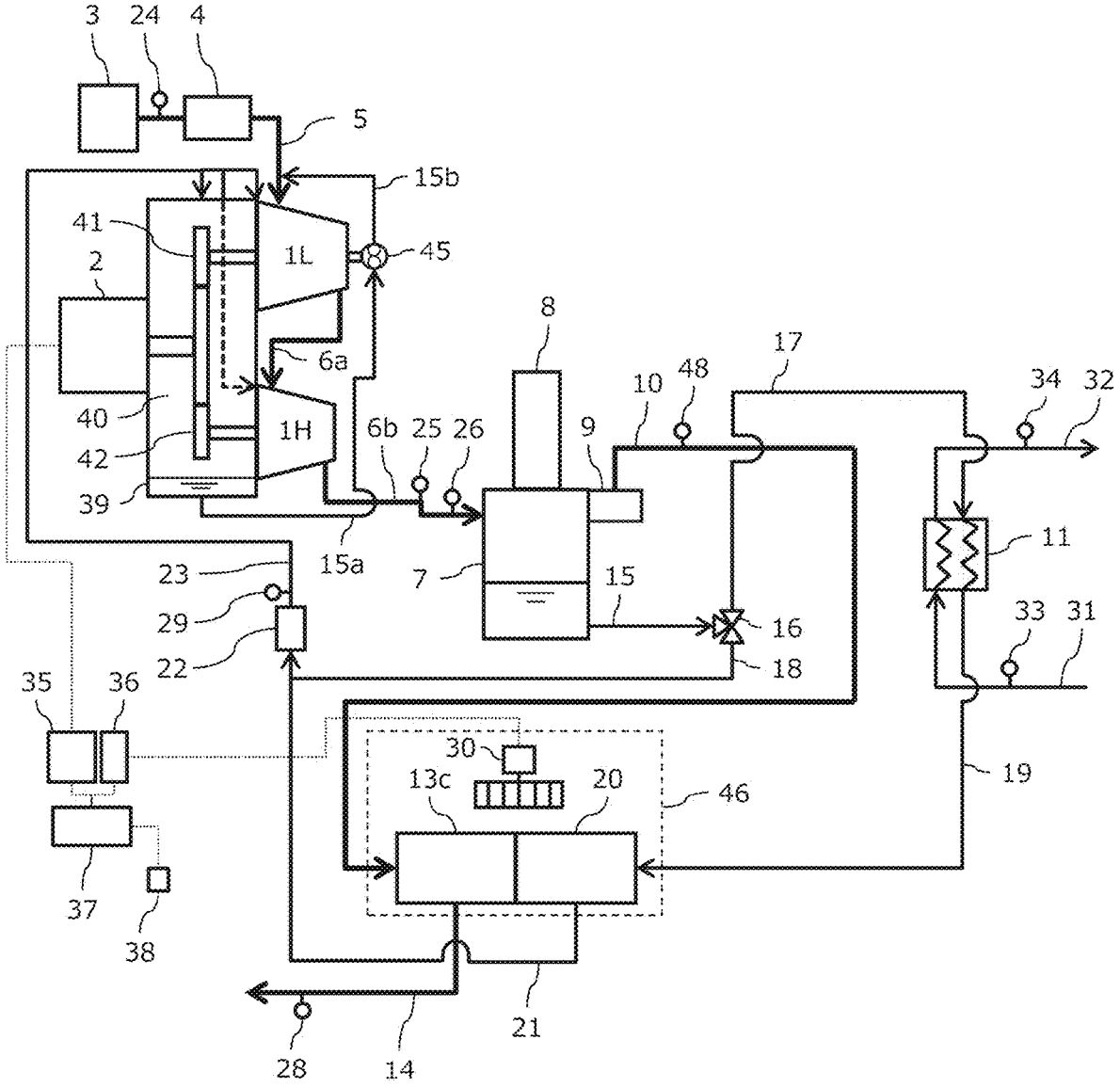
FIG. 8 is a schematic diagram illustrating a general configuration of a gas compressor according to a fourth embodiment of the present invention.

FIG. 8 is a schematic diagram illustrating a general configuration of a gas compressor according to a fourth embodiment of the present invention. The fourth embodiment will be described below mainly with respect to its differences from the first embodiment.

Compressor main bodies 1L and 1H according to the present embodiment are of a two-stage compression system including a low-pressure stage compressor main body 1L and a high-pressure stage compressor main body 1H. The low-pressure stage compressor main body 1L and the high-pressure stage compressor main body 1H are mounted on a gear case 39, and a low-pressure stage pinion 41 and a high-pressure stage pinion 42 are mounted on respective driven shaft ends of the low-pressure stage compressor main body 1L and the high-pressure stage compressor main body 1H. The main motor 2 has a drive shaft with a bull gear 40 mounted thereon. The low-pressure stage pinion 41 and the high-pressure stage pinion 42 are held in mesh with the bull gear 40. When the main motor 2 rotates the drive shaft thereof, the low-pressure stage compressor main body 1L and the high-pressure stage compressor main body 1H are driven. The low-pressure stage compressor main body 1L has a driven shaft end to which there is connected an oil pump 45 through a shaft coupling or transmission gears, not depicted, so that the oil pump 45 is driven by the rotation of the driven shaft of the low-pressure stage compressor main body 1L.

Air that is sucked in through the intake filter 3, the intake valve 4, and an intake passage 5 flows into the low-pressure stage compressor main body 1L. The compressed air whose pressure has been increased to a predetermined low-pressure stage discharge pressure thereby flows through a discharged air passage 6*a* into the high-pressure stage compressor main body 1H. The compressed air whose pressure has been increased to a predetermined discharge pressure thereby flows through a discharged air passage 6*b* into the primary oil separator 7. The discharged air system that follows the primary oil separator 7 is the same as that illustrated in FIG. 1.

The oil passage configuration from the primary oil separator 7 to the oil filter 22 is the same as that illustrated in FIG. 1. The lubricating oil that has passed through the oil filter 22 is supplied to the gears, shaft seal parts, and bearings, not depicted, in the gear case 39 and also to the screw rotors and bearings in the low-pressure stage compressor main body 1L and the high-pressure stage compressor main body 1H, lubricating these drive parts. Further, the oil pump 45 sucks in the lubricating oil stored in the lower portion of the gear case 39 via an oil passage 15*a*, and then delivers the lubricating oil under pressure through an oil passage 15*b* into the intake passage 5. The lubricating oil then flows together with the intake air into the low-pressure stage compressor main body 1L, sealing air in the working chamber and lubricating the screw rotors.

The waste-heat-recovery heat exchanger 11, the oil cooler 20 and the aftercooler 13*c* that finally cool the lubricating oil and the compressed air, and the water supply passages, the oil passages, and the discharged air passages connected thereto are identical in basic configuration to those illustrated in FIG. 1. Further, the configuration of cooling fan 30, the cooling fan inverter 36 for controlling the cooling fan 30, and the various temperature and pressure sensors are also the same as those according to the first embodiment (FIG. 1). Therefore, the flowchart (FIG. 2 or 5) according to the first embodiment can be executed in the same manner, and a characteristic curve corresponding to the curve 1 illustrated in FIG. 4 can be used in the calculation of the target discharged air temperature Td1*t* corresponding to the target water outlet temperature Tw2*t*.

As with the present embodiment, a function to recover waste heat from the lubricating oil as a high-temperature fluid and a function to supply hot water at the target water outlet temperature Tw2*t* can be configured irrespectively of the number of compressor main bodies and the way in which they are driven. Generally, an oil-cooled compressor including a plurality of compressor main bodies includes a large-output motor and uses an increased amount of lubricating oil to circulate therein. Therefore, the amount of heat to be recovered from the waste heat is relatively large and the amount of hot water that can be supplied is also large, resulting in a high energy saving capability. Because of the large amount of hot water, a large-size water temperature adjusting valve that has heretofore been required is not necessary, and hence the cost of installation is greatly reduced.

Summary

The compressor main bodies 1L and 1H according to the present embodiment are of the multiple-stage type.

According to the present embodiment configured as described above, the multiple-stage-type gas compressor is able to adjust the temperature of the heat recovery liquid discharged from the waste-heat-recovery heat exchanger 11 to a desired temperature at a low cost without providing a temperature adjusting valve or the like in the passage of the heat recovery liquid.

Fifth Embodiment

Figure 9:
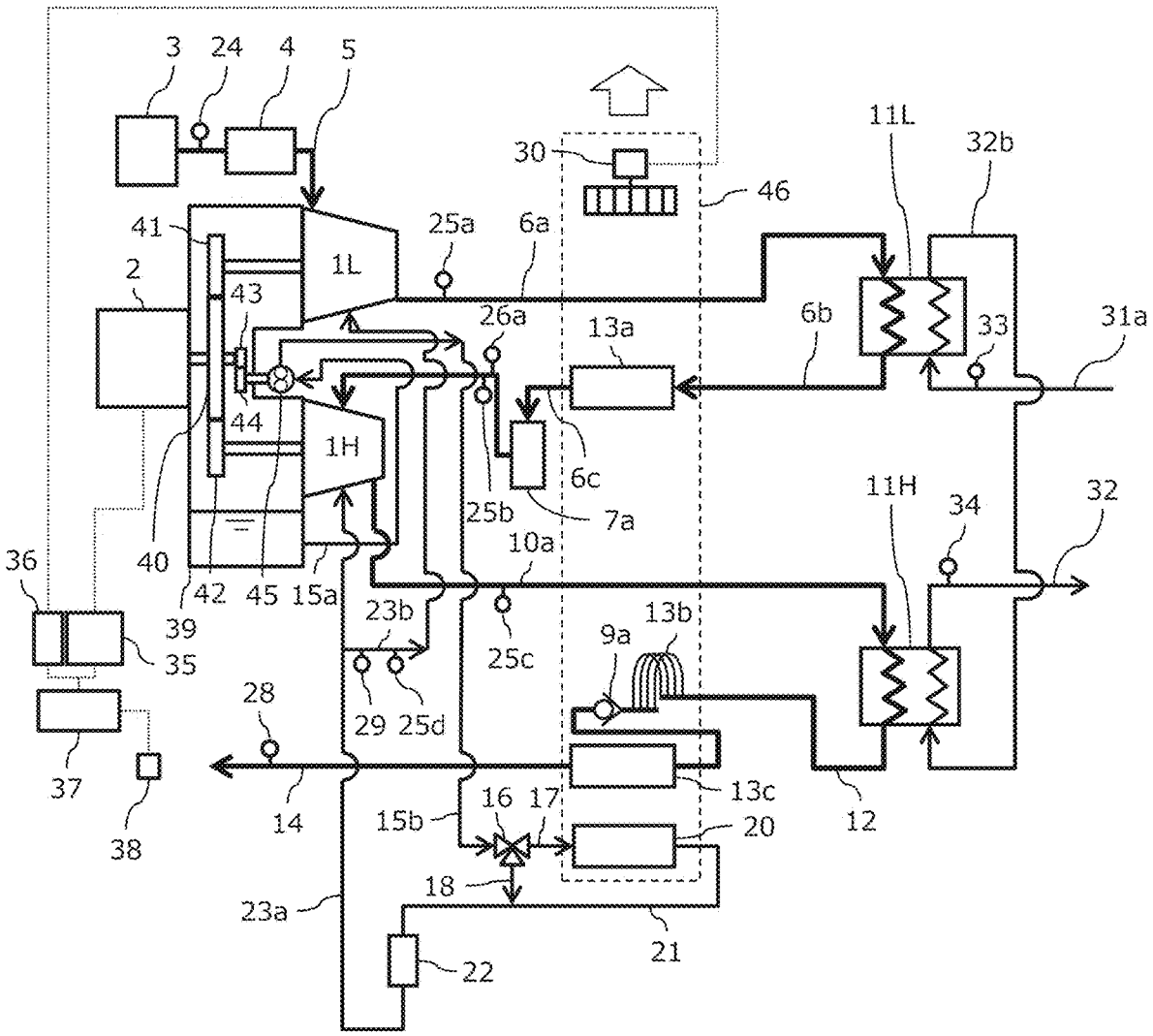
FIG. 9 is a schematic diagram illustrating a general configuration of a gas compressor according to a fifth embodiment of the present invention.

FIG. 9 is a schematic diagram illustrating a general configuration of a gas compressor according to a fifth embodiment of the present invention. The fifth embodiment will be described below mainly with respect to its differences from the first embodiment.

The gas compressor according to the present embodiment is of the non-oil-fed type (non-liquid-fed type) in which a cooling liquid or a lubricating liquid is not injected into the working chambers in compressor main bodies, and is of a two-stage compression system including a low-pressure stage compressor main body 1L and a high-pressure stage compressor main body 1H. Each of the low-pressure stage compressor main body 1L and the high-pressure stage compressor main body 1H includes a pair of male and female screw rotors, not depicted, housed therein that can be rotated out of contact with each other while keeping minute gaps therebetween by synchronous gears mounted on the shaft ends of the screw rotors.

The low-pressure stage compressor main body 1L and the high-pressure stage compressor main body 1H are mounted on a gear case 39, and a low-pressure stage pinion 41 and a high-pressure stage pinion 42 are mounted on respective driven shaft ends of the low-pressure stage compressor main body 1L and the high-pressure stage compressor main body 1H. The main motor 2 has a drive shaft with a bull gear 40 mounted thereon. The low-pressure stage pinion 41 and the high-pressure stage pinion 42 are held in mesh with the bull gear 40. When the main motor 2 rotates the drive shaft thereof, the low-pressure stage compressor main body 1L and the high-pressure stage compressor main body 1H are driven. An oil pump pinion 43 is mounted on an end of the drive shaft of the main motor 2 and held in mesh with an oil pump gear 44 mounted on a driven shaft of an oil pump 45, so that the oil pump 45 can be driven by the main motor 2.

The compressed air discharged from the low-pressure stage compressor main body 1L flows through the discharged air passage 6*a* into a high-temperature fluid passage in a low-pressure stage waste-heat-recovery heat exchanger 11L that performs a heat exchange between the compressed air and water passing through a low-temperature fluid passage. Thereafter, the compressed air flows through a discharged air passage 6*b* into an intercooler 13*a* that cools the compressed air to a predetermined temperature. Thereafter, after condensed water has been separated from the compressed air in a condensed water separator 7*a* provided on a discharged air passage 6*c*, the compressed air flows into the high-pressure stage compressor main body 1H. That is, the discharged air passage 6*c* refers to a passage that allows the high-temperature fluid (the compressed air) cooled by the air-cooled cooler (the intercooler 13*a*) to flow therethrough into the compressor main body (the high-pressure stage compressor main body 1H). The compressed air whose pressure has been increased to a predetermined pressure by the low-pressure stage compressor main body 1H flows through a discharged air passage 10*a* into a high-temperature fluid passage in a high-pressure stage waste-heat-recovery heat exchanger 11H that performs a heat exchange between the compressed air and water passing through a low-temperature fluid passage. Thereafter, the compressed air flows into a discharged air passage 12 and is precooled by cooling air produced by the cooling fan 30 in an air-cooled precooler 13*b* provided on the discharged air passage 12, after which the compressed air passes through a check valve 9*a* and flows into the aftercooler 13*c*. The compressed air that has been cooled by the aftercooler 13*c* is supplied through the discharged air passage 14 to the demanders.

Non-oil-fed-type compressors in which no oil is supplied to the working chambers of the compressor main bodies require a lubricating oil for lubricating drive parts such as gears and bearings, not depicted, and cooling the casings of the compressor main bodies that tend to be heated to a high temperature by the heat of compression of air, and hence require an oil pump for circulating the lubricating oil. The oil pump 45 that is driven by the main motor 2 sucks in the lubricating oil stored in the lower portion of the gear case 39 via the oil passage 15*a*, and then delivers the lubricating oil under pressure through the oil passage 15*b*. The temperature control valve 16 is provided on the oil passage 15*b*. When the lubricating oil temperature is lower than a predetermined temperature, then the lubricating oil flows in its entirety into the oil bypass passage 18 in bypassing relation to the oil cooler 20 and is supplied via the oil passage 21, the oil filter 22, and an oil passage 23*a* and then through an oil passage 23*b* that branches from the oil passage 23*a* to the low-pressure stage compressor main body 1L and through the oil passage 23*a* to the high-pressure stage compressor main body 1H, where the lubricating oil is used to lubricate the bearings, not depicted, in the compressor main bodies and the synchronous gears for rotating the pairs of male and female screw rotors out of contact with each other, and is used to cool the compressor main bodies by flowing through cooling liquid passages (separate passages for preventing the lubricating oil from being mixed with the compressed air) in the casings of the compressor main bodies. The lubricating oil is also supplied to drive parts such as gears and bearings in the gear case 39 through other branching oil passages, not depicted. When the lubricating oil temperature becomes higher than a predetermined temperature, the temperature control valve 16 adjusts the amount of distribution of the oil to be distributed to the oil bypass passage 18 and to the oil passage 17 depending on the lubricating oil temperature. The lubricating oil flows through the oil passage 17 into the oil cooler 20 in which the lubricating oil is cooled by cooling air, after which the lubricating oil is supplied through the oil passage 21 finally to the low-pressure stage compressor main body 1L and the high-pressure stage compressor main body 1H. That is, the oil passage 21 refers to a passage that allows the high-temperature fluid (compressed air) cooled by the air-cooled cooler (oil cooler 20) to flow therethrough into the compressor main bodies (the low-pressure stage compressor main body 1L and the high-pressure stage compressor main body 1H).

According to the present embodiment, water and the compressed air exchange heat with each other first in the low-pressure stage waste-heat-recovery heat exchanger 11L and then in the high-pressure stage waste-heat-recovery heat exchanger 11H in a series-connected sequence. More specifically, the water that has passed through a water supply passage 31*a* flows into the low-temperature fluid passage in the low-pressure stage waste-heat-recovery heat exchanger 11L in which the water is heated by the high-temperature compressed air discharged from the low-pressure stage compressor main body 1L. Thereafter, the water flows through a water supply passage 31*b* into the low-temperature fluid passage in the high-pressure stage waste-heat-recovery heat exchanger 11H in which the water is heated by the high-temperature compressed air discharged from the high-pressure stage compressor main body 1H. Finally, the water is supplied from the water supply passage 32 to hot-water demanders. Here, according to the present embodiment, a compression ratio, which represents the ratio between an intake pressure and a discharge pressure, is assumed to be lower in the low-pressure stage compressor main body 1L than in the high-pressure stage compressor main body 1H, and the discharged air temperature at the outlet of the low-pressure stage compressor main body 1L is lower. Therefore, in order to maximize the amount of heat to be exchanged, it is preferable to perform at first a heat exchange between water at a lowest temperature supplied from the water supply source and the low-pressure stage discharged air. However, if the gas compressor is designed such that the compression ratio in the high-pressure stage compressor main body 1H is smaller than the compression ratio in the low-pressure stage compressor main body 1L, then the waste-heat-recovery heat exchangers may be connected in such a sequence that the high-pressure stage waste-heat-recovery heat exchanger 11H precedes the low-pressure stage waste-heat-recovery heat exchanger 11L.

In non-oil-fed-type compressors, most of the amount of generated heat exists as sensible heat of compressed air. It is often customary to perform a heat exchange between the compressed air and water to recover heat from the compressed air, as with the present embodiment. According to the present embodiment, no waste heat is recovered from the oil, and the rotation of the cooling fan 30 may be controlled such that the water outlet temperature Tw2 reaches the target water outlet temperature Tw2*t* as is the case with the flowchart (FIG. 2) according to the first embodiment.

Figure 10:
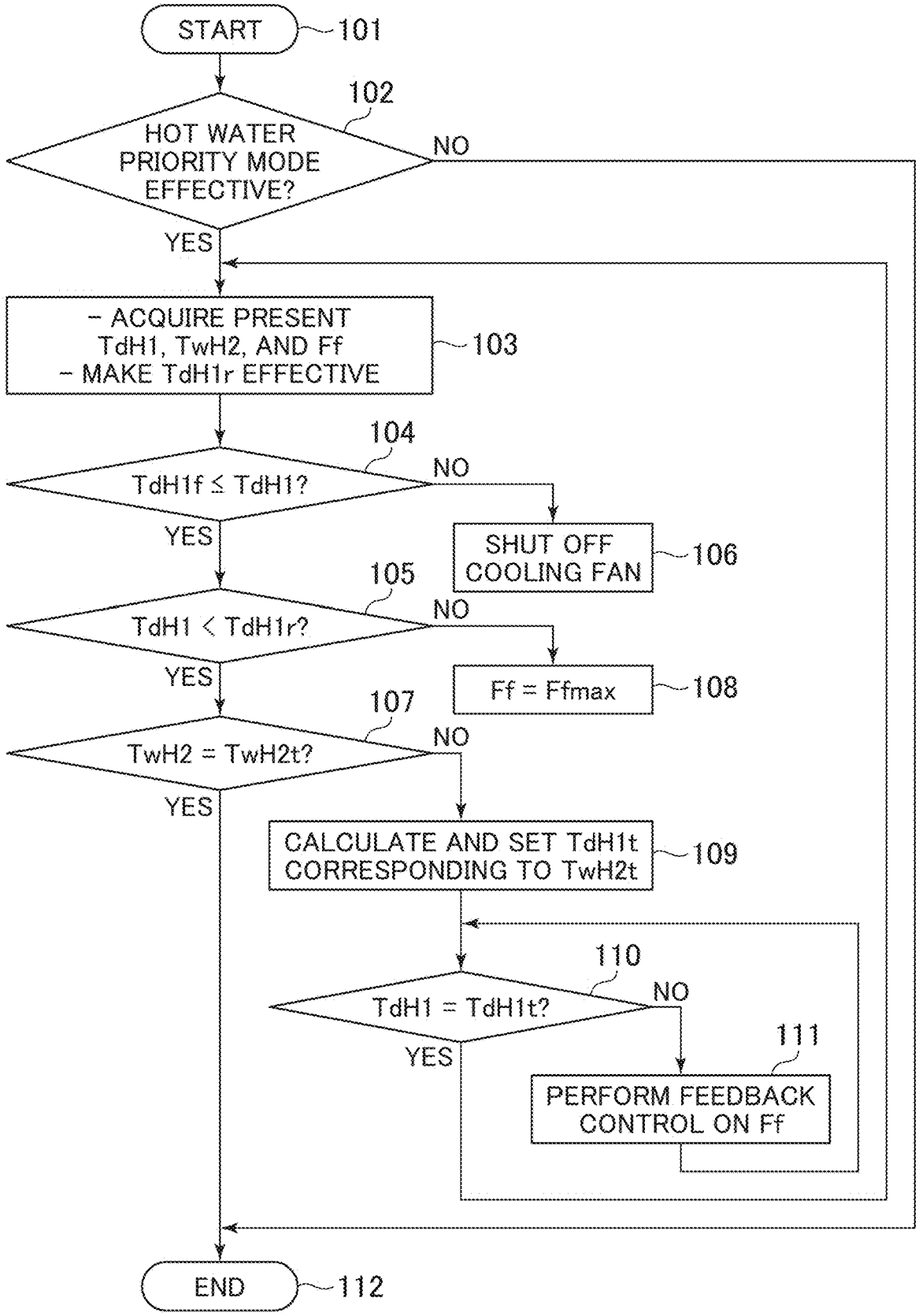
FIG. 10 is a flowchart of a control sequence for adjusting a water outlet temperature to a target water outlet temperature in the gas compressor according to the fifth embodiment of the present invention.

FIG. 10 is a flowchart of a control sequence for adjusting the water outlet temperature Tw2 to the target water outlet temperature Tw2*t* in the gas compressor according to the present embodiment. According to the present embodiment, a high-pressure stage discharged air temperature TdH1 is used instead of the discharged air temperature Td1 according to the first embodiment. In addition, a high-pressure stage discharged air alarm temperature TdH1A is used instead of the discharged air alarm temperature Td1A. Further, when the hot water priority mode is effective, a hot-water-priority-mode high-pressure stage discharged air upper-limit temperature TdH1*r* is used instead of the hot-water-priority-mode discharged air upper-limit temperature Td1*r*. Furthermore, a fan-control-start high-pressure stage discharged air temperature TdH1*f* is used instead of the fan-control-start discharged air temperature Td1*f*. Still furthermore, a target high-pressure stage discharged air temperature TdH1*t* is used instead of the target discharged air temperature Td1*t*. Though the parameters used to determine conditions are changed as described above, the steps of the control sequence illustrated in FIG. 10 are the same as those according to the first embodiment (FIG. 2).

Figure 11:
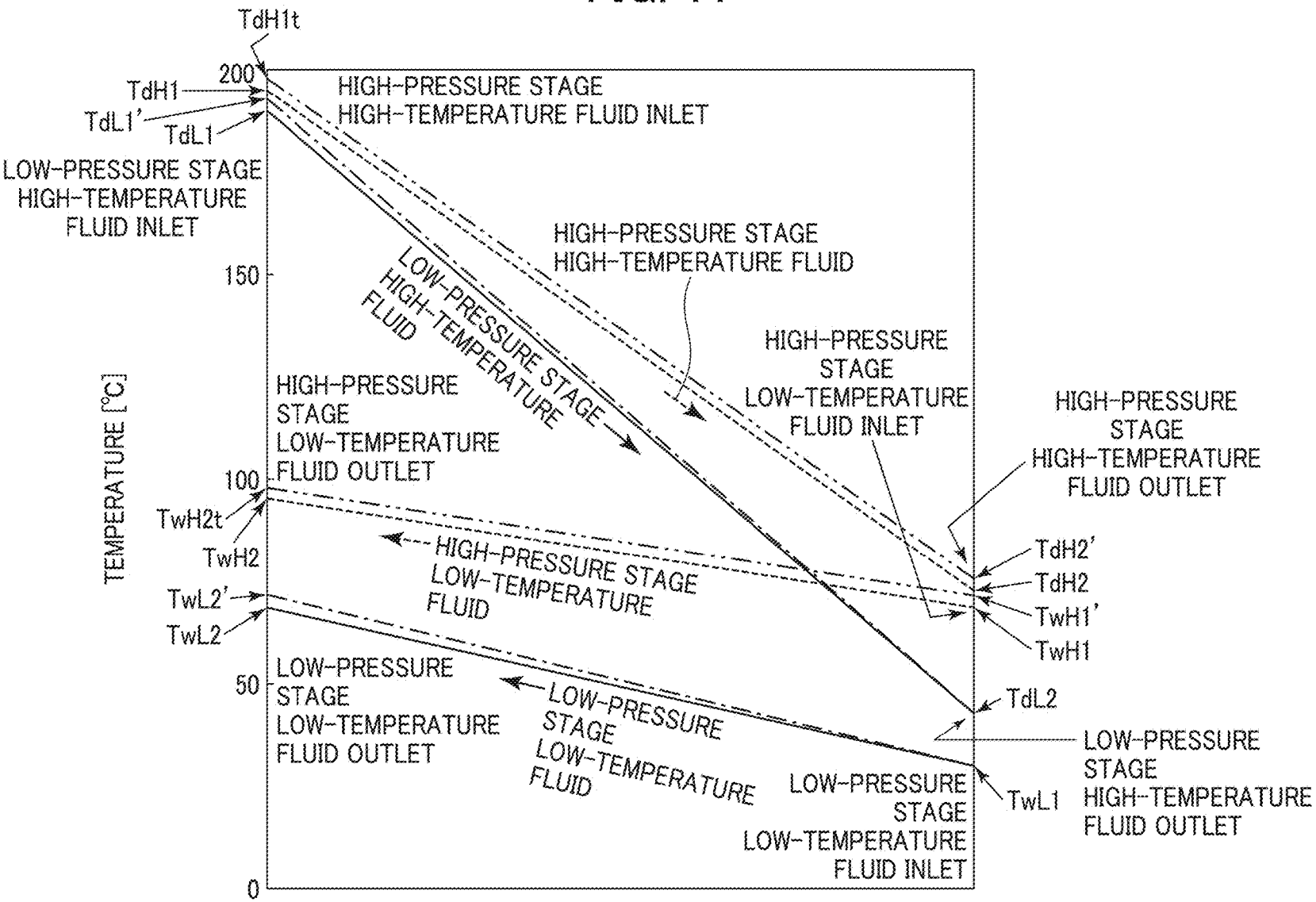
FIG. 11 is a diagram illustrating the inlet and outlet temperatures of a high-temperature fluid and a low-temperature fluid in a low-pressure stage waste-heat-recovery heat exchanger and a high-pressure stage waste-heat-recovery heat exchanger according to the fifth embodiment of the present invention.

FIG. 11 is a diagram illustrating the inlet and outlet temperatures of a high-temperature fluid (compressed air) and a low-temperature fluid (water) in the low-pressure stage waste-heat-recovery heat exchanger 11L and the high-pressure stage waste-heat-recovery heat exchanger 11H according to the present embodiment. Each of the low-pressure stage waste-heat-recovery heat exchanger 11L and the high-pressure stage waste-heat-recovery heat exchanger 11H is a counterflow-type heat exchanger. A low-pressure stage logarithmic average temperature difference ΔTmL of the low-pressure stage waste-heat-recovery heat exchanger 11L is expressed by:

$$\Delta TmL = ((TdL1 - TwL2) - (TdL2 - TwL1))/\mathrm{LN}\big((TdL1 - TwL2)/(TdL2 - TwL1)\big)$$

A high-pressure stage logarithmic average temperature difference ΔTmH of the high-pressure stage waste-heat-recovery heat exchanger 11H is expressed by:

$$\Delta TmH = ((TdH1 - TwH2) - (TdH2 - TwH1))/\mathrm{LN}\big((TdH1 - TwH2)/(TdH2 - TwH1)\big)$$

Inasmuch as the low-pressure stage waste-heat-recovery heat exchanger 11L and the high-pressure stage waste-heat-recovery heat exchanger 11H are connected in series with each other, the amounts of water flowing into them are the same as each other. Assuming that the amounts of water are constant and the water inlet temperature (=the low-pressure stage low-temperature fluid inlet temperature) TwL1 is constant, the low-pressure stage low-temperature fluid outlet temperature TwL2 of the low-pressure stage waste-heat-recovery heat exchanger 11L and the high-pressure stage low-temperature fluid inlet temperature TwH1 of the high-pressure stage waste-heat-recovery heat exchanger 11H are the same as each other, i.e., TwH1=TwL2 (it is assumed here that the water supply passage 31*b* is protected by a thermal insulation, preventing heat from entering or leaving itself).

A low-pressure stage high-temperature fluid outlet temperature TdL2 of the compressed air cooled in a heat exchange with water by the low-pressure stage waste-heat-recovery heat exchanger 11L and flowing out of the low-pressure stage high-temperature fluid outlet is cooled approximately to a temperature represented by the atmospheric temperature+15° C. Thereafter, the compressed air is compressed by the high-pressure stage compressor main body 1H and flows at the high-pressure stage discharged air temperature (=the high-pressure stage high-temperature fluid inlet temperature) TdH1 into the high-pressure stage waste-heat-recovery heat exchanger 11H. Consequently, normally, the low-pressure stage high-temperature fluid outlet temperature TdL2 and the high-pressure stage high-temperature fluid inlet temperature TdH1 do not coincide with each other though the heat exchangers are connected in series with each other, unlike the low-pressure stage low-temperature fluid outlet temperature TwL2 and the high-pressure stage low-temperature fluid inlet temperature TwH1.

In general non-oil-fed-type compressors, a discharged air temperature (absolute temperature) [K] immediately after compression is determined in accordance with (intake air absolute temperature)×(discharged air absolute pressure/intake air absolute pressure)^((κ−1)/(m·K)), where κ represents the ratio of specific heat of air (=1.4) and m represents the number of compression stages. Depending on the discharged pressure specification of the compressor, in a case where the discharged air pressure specification represents 0.7 Mpa (gage pressure), it is general to design compressor details such that the compression ratios (=(discharged air absolute pressure/intake air absolute pressure)) of the low-pressure stage and the high-pressure stage are approximately the same as each other. Therefore, assuming that the discharged air temperatures of the low-pressure stage compressor main body 1L and the high-pressure stage compressor main body 1H are represented by m=1, the low-pressure stage and high-pressure stage compressor main body outlet temperatures, i.e., a low-pressure stage discharged air temperature (=a low-pressure stage high-temperature fluid inlet temperature) TdL1 and the high-pressure stage discharged air temperature (=the high-pressure stage high-temperature fluid inlet temperature) TdH1 are individually calculated as being approximately in the range from 180° C. to 210° C.

As with the first embodiment, in order to increase the high-pressure stage low-temperature fluid outlet temperature of the high-pressure stage waste-heat-recovery heat exchanger 11H, i.e., the water outlet temperature TwH2, up to a target high-pressure stage water outlet temperature TwH2*t* (TwH2<TwH2*t*), the low-pressure stage high-temperature fluid inlet temperature TdL1 and the high-pressure stage high-temperature fluid inlet temperature TdH1 may be increased. Unlike the oil-cooled-type compressor, the non-oil-fed-type compressor does not inject a lubricating oil into the working chamber in the compressor main body. However, when the rotational speed of the cooling fan 30 is reduced, the lubricating oil temperature at the outlet of the oil cooler 20 increases, resulting in a reduction in the cooling capability of the lubricating oil flowing through the cooling liquid passages, not illustrated, in the low-pressure stage compressor main body 1L and the high-pressure stage compressor main body 1H. At the same time, the reduction in the rotational speed of the cooling fan 30 reduces the cooling capability of the intercooler 13*a*. Consequently, the low-pressure stage discharged air temperature (=the low-pressure stage high-temperature fluid inlet temperature) TdL1 of the low-pressure stage compressor main body 1L and the high-pressure stage discharged air temperature (=the high-pressure stage high-temperature fluid inlet temperature) TdH1 of the high-pressure stage compressor main body 1H are increased, thereby making it possible to increase the water outlet temperature TwH2.

When the low-pressure stage water inlet temperature TwL1 is given and the high-pressure stage water outlet temperature TwH2 is set to TwH2=TwH2*t*, the target high-pressure stage discharged air temperature TdH1*t* is determined such that the low-pressure stage logarithmic average temperature difference ΔTmL and the high-pressure stage logarithmic average temperature difference ΔTmH are the same as each other before and after setting of the high-pressure stage water outlet temperature TwH2, thereby obtaining the characteristics illustrated in FIG. 11.

As with the first embodiment, by preparing a characteristic curve by calculating the relationship between the target high-pressure stage water outlet temperature TwH2*t* and the target high-pressure stage discharged air temperature TdH1*t* with respect to the combination of the low-pressure stage waste-heat-recovery heat exchanger 11L and the high-pressure stage waste-heat-recovery heat exchanger 11H that have been employed in advance, a corresponding target high-pressure stage discharged air temperature TdH1*t* can easily be obtained when the operator sets a desired target high-pressure stage water outlet temperature TwH2*t*. A curve 2 illustrated in FIG. 4 is a characteristic curve representing the relationship between the target high-pressure stage water outlet temperature TwH2*t* and the target high-pressure stage discharged air temperature TdH1*t* according to the present embodiment. When a desired target high-pressure stage water outlet temperature TwH2*t* is set, a cooling fan inverter output frequency Ff may be feedback-controlled to adjust the high-pressure stage discharged air temperature Td1H such that a corresponding target high-pressure stage discharged air temperature Td1*t* is obtained, according to the flowchart illustrated in FIG. 10.

However, even if a target high-pressure stage water outlet temperature TwH2*t* is to be set to a temperature that is much lower than that in normal times, the low-pressure stage discharged air temperature TdL1 and the high-pressure stage discharged air temperature TdH1 have been physically determined by the intake air temperature and the compression ratio. Accordingly, in a case where the cooling fan 30 is operated at full speed, i.e., a cooling fan inverter maximum output frequency Ffmax is reached, as a result of the feedback control on the cooling fan inverter output frequency Ff, there is a lower limit for the target high-pressure stage discharged air temperature TdH1*t* if the unit outlet discharged air pressure Pd is constant. For example, if the atmospheric temperature is 20° C., then the lower limit for the target high-pressure stage discharged air temperature TdH1*t* is expected to be approximately 170° C.

Figure 12:
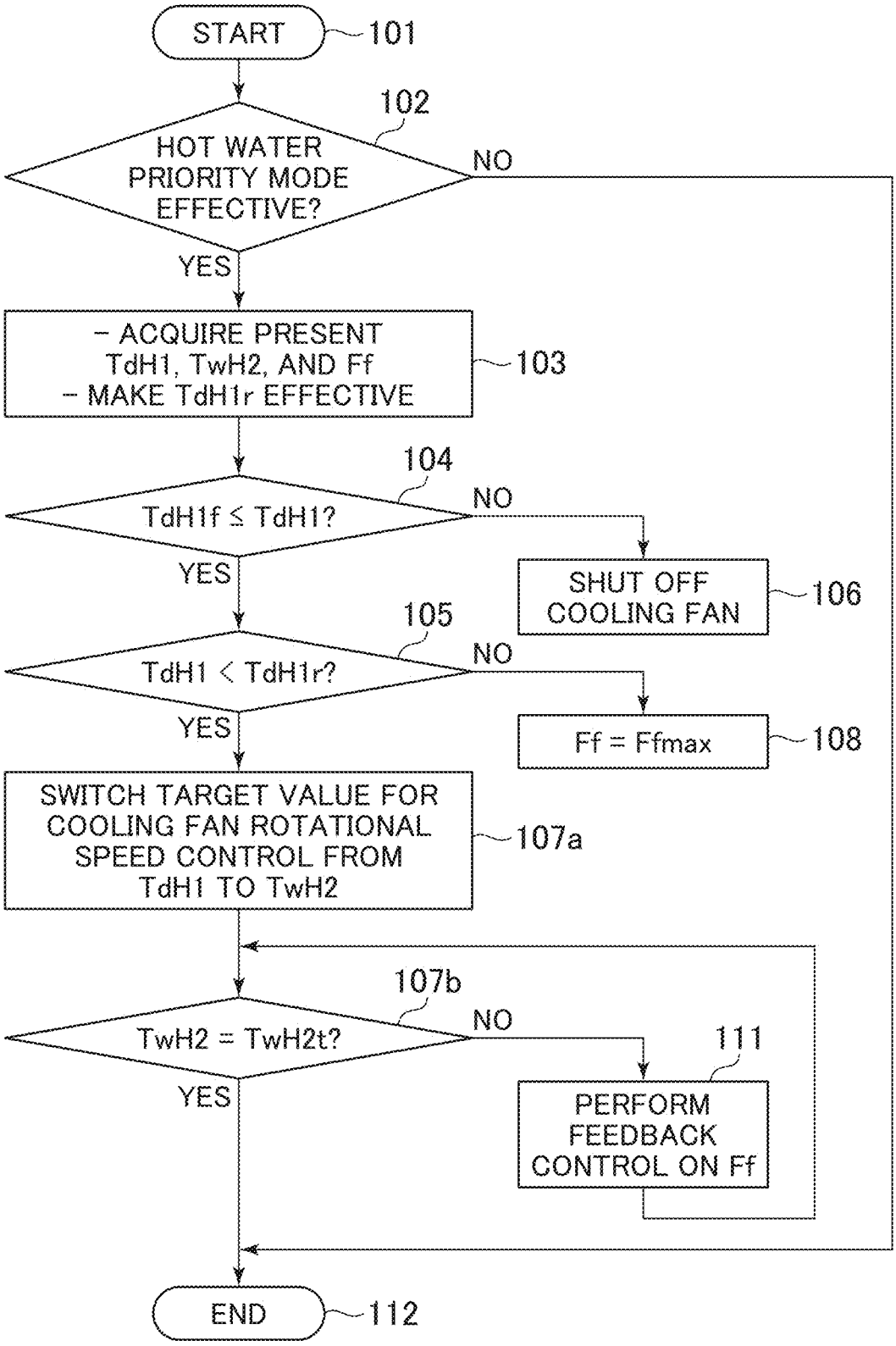
FIG. 12 is a flowchart of a modification of the control sequence for adjusting a water outlet temperature to a target water outlet temperature in the gas compressor according to the fifth embodiment of the present invention.

FIG. 12 is a flowchart of a modification of the control sequence (FIG. 10) for adjusting the water outlet temperature Tw2 to a target water outlet temperature Tw2*t* in the gas compressor according to the present embodiment. The parameters used in the flowchart of FIG. 12 are identical to those used in the flowchart of FIG. 10. Moreover, the steps of the control sequence illustrated in FIG. 12 are identical to those according to the first embodiment (FIG. 5).

Summary

The compressor main bodies 1L and 1H according to the present embodiment are of the non-liquid-fed type in which a cooling liquid or a lubricating liquid is not injected into the working chambers in compressor main bodies. The high-temperature fluid flowing into the waste-heat-recovery heat exchangers 11L and 11H includes the compressed gas discharged from the compressor main bodies 1L and 1H.

According to the present embodiment configured as described above, it is possible to adjust the temperature of the heat recovery liquid discharged from the waste-heat-recovery heat exchangers 11L and 11H to a desired temperature at a low cost without providing a temperature adjusting valve in the passage of the heat recovery liquid in the non-liquid-fed-type gas compressor.

Furthermore, the compressor main bodies 1L and 1H according to the present embodiment include the low-pressure stage compressor main body 1L and the high-pressure stage compressor main body 1H, and the waste-heat-recovery heat exchangers 11L and 11H include the low-pressure stage waste-heat-recovery heat exchanger 11L that performs a heat exchange between the compressed gas discharged as a high-temperature fluid from the low-pressure stage compressor main body 1L and the heat recovery liquid as a low-temperature fluid, and the high-pressure stage waste-heat-recovery heat exchanger 11H that performs a heat exchange between the compressed gas discharged as a high-temperature fluid from the high-pressure stage compressor main body 1H and the heat recovery liquid as a low-temperature fluid, and the low-pressure stage waste-heat-recovery heat exchanger 11L and the high-pressure stage waste-heat-recovery heat exchanger 11H have respective low-temperature fluid passages connected in series with each other. Thus, since the heat recovery liquid is heated by the compressed gas discharged from the low-pressure stage compressor main body 1L and the high-pressure stage waste-heat-recovery heat exchanger 11H, it is possible to increase the temperature of the heat recovery liquid.

Sixth Embodiment

Figure 13:
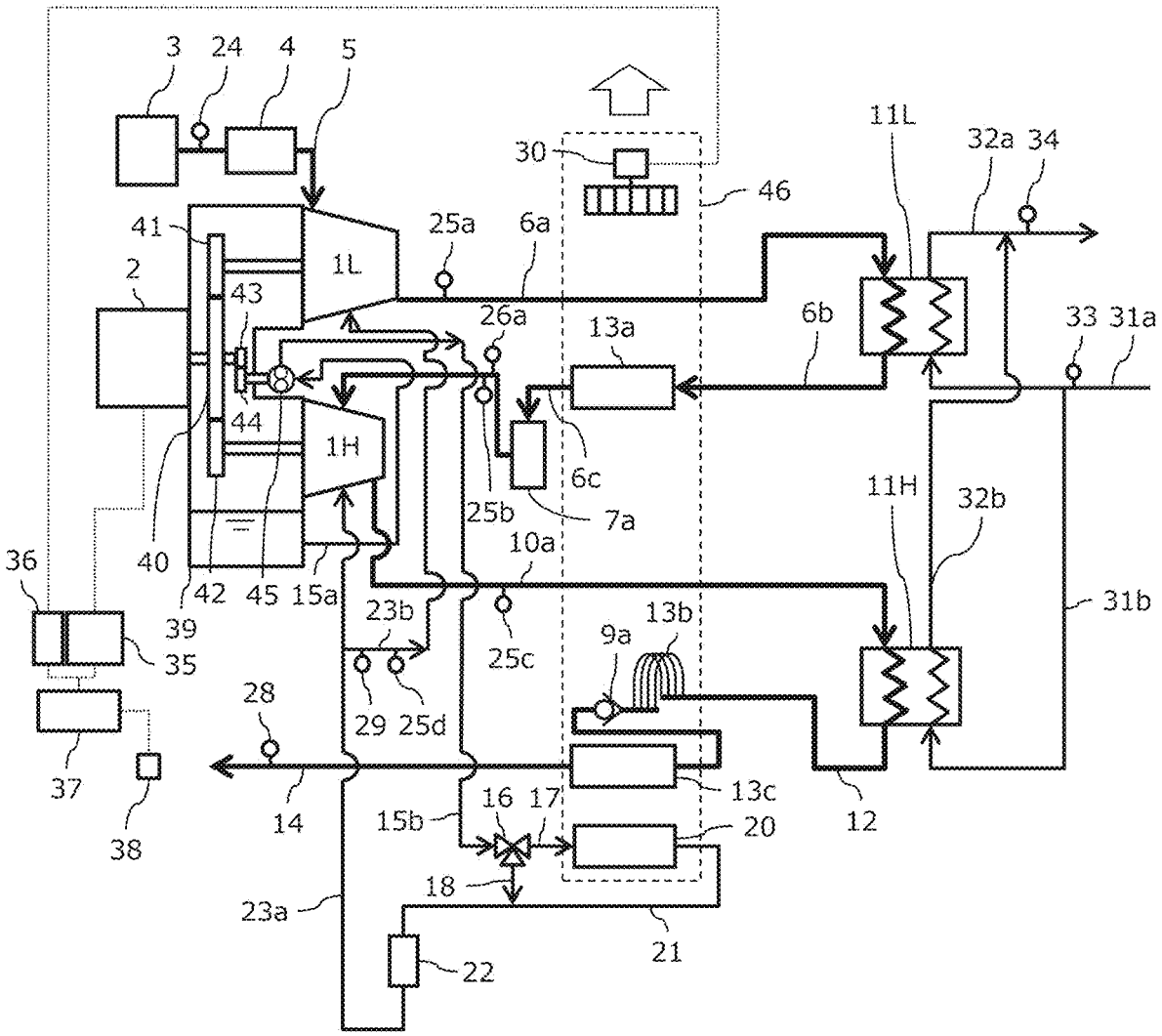
FIG. 13 is a schematic diagram illustrating a general configuration of a gas compressor according to a sixth embodiment of the present invention.

FIG. 13 is a schematic diagram illustrating a general configuration of a gas compressor according to a sixth embodiment of the present invention. The sixth embodiment will be described below mainly with respect to its differences from the fifth embodiment.

According to the fifth embodiment (FIG. 9), the low-temperature fluid passages in the low-pressure stage waste-heat-recovery heat exchanger 11L and the high-pressure stage waste-heat-recovery heat exchanger 11H are connected in series with each other. According to the present embodiment, in contrast, the low-temperature fluid passages in the low-pressure stage waste-heat-recovery heat exchanger 11L and the high-pressure stage waste-heat-recovery heat exchanger 11H are connected parallel to each other.

The water supply passage 31*a* that introduces water from the water supply source branches into a water supply passage 31*b*. The water supply passage 31*a* is connected to the low-pressure stage waste-heat-recovery heat exchanger 11L, whereas the water supply passage 31*b* is connected to the high-pressure stage waste-heat-recovery heat exchanger 11H. Water that is heated by the low-pressure stage waste-heat-recovery heat exchanger 11L flows into a water supply passage 32*a*, and water that is heated by the high-pressure stage waste-heat-recovery heat exchanger 11H flows into a water supply passage 32*b*. The water supply passage 32*b* is joined to the water supply passage 32*a* to supply hot water to hot-water demanders. The water inlet temperature is detected by the water inlet temperature sensor 33 provided on the water supply passage 31*a* on an upstream side of the branch point where the water supply passage 31*b* branches from the water supply passage 31*a*, and the water outlet temperature is detected by the water outlet temperature sensor 34 provided on the water supply passage 32*a* on a downstream side of the joining point where the water supply passage 32*b* is joined to the water supply passage 32*a*.

With this configuration, since the low-temperature fluid passages in the low-pressure stage waste-heat-recovery heat exchanger 11L and the high-pressure stage waste-heat-recovery heat exchanger 11H are connected parallel to each other, the difference between the water inlet temperature Tw1 on the low-temperature side and the low-pressure stage discharged air temperature TdL1 or the high-pressure stage discharged air temperature TdH1 on the high-temperature side is kept larger than that where the low-temperature fluid passages in the low-pressure stage waste-heat-recovery heat exchanger 11L and the high-pressure stage waste-heat-recovery heat exchanger 11H are connected in series with each other according to the fifth embodiment (FIG. 9). This results in a larger amount of heat being exchanged to increase an energy saving capability. On the other hand, the high-pressure stage water outlet temperature TwH2 is made lower than that where the low-temperature fluid passages in the low-pressure stage waste-heat-recovery heat exchanger 11L and the high-pressure stage waste-heat-recovery heat exchanger 11H are connected in series with each other according to the fifth embodiment.

The group of heat exchangers connected parallel to each other can be regarded as a single heat exchanger, and its characteristic curve is represented by the curve 1 illustrated in FIG. 4.

Summary

The compressor main bodies 1L and 1H according to the present embodiment include the low-pressure stage compressor main body 1L and the high-pressure stage compressor main body 1H, and the waste-heat-recovery heat exchangers 11L and 11H include the low-pressure stage waste-heat-recovery heat exchanger 11L that performs a heat exchange between the compressed gas discharged as a high-temperature fluid from the low-pressure stage compressor main body 1L and the heat recovery liquid as a low-temperature fluid, and the high-pressure stage waste-heat-recovery heat exchanger 11H that performs a heat exchange between the compressed gas discharged as a high-temperature fluid from the high-pressure stage compressor main body 1H and the heat recovery liquid as a low-temperature fluid, the low-temperature fluid passages in the low-pressure stage waste-heat-recovery heat exchanger 11L and the high-pressure stage waste-heat-recovery heat exchanger 11H being connected parallel to each other.

According to the present embodiment configured as described above, since the low-temperature fluid passages in the low-pressure stage waste-heat-recovery heat exchanger 11L and the high-pressure stage waste-heat-recovery heat exchanger 11H are connected parallel to each other, the difference between the water inlet temperature Tw1 on the low-temperature side and the low-pressure stage discharged air temperature TdL1 or the high-pressure stage discharged air temperature TdH1 on the high-temperature side is kept large. This results in an increased amount of heat that can be exchanged, and thus it is possible to increase an energy saving capability.

Seventh Embodiment

Figure 14:
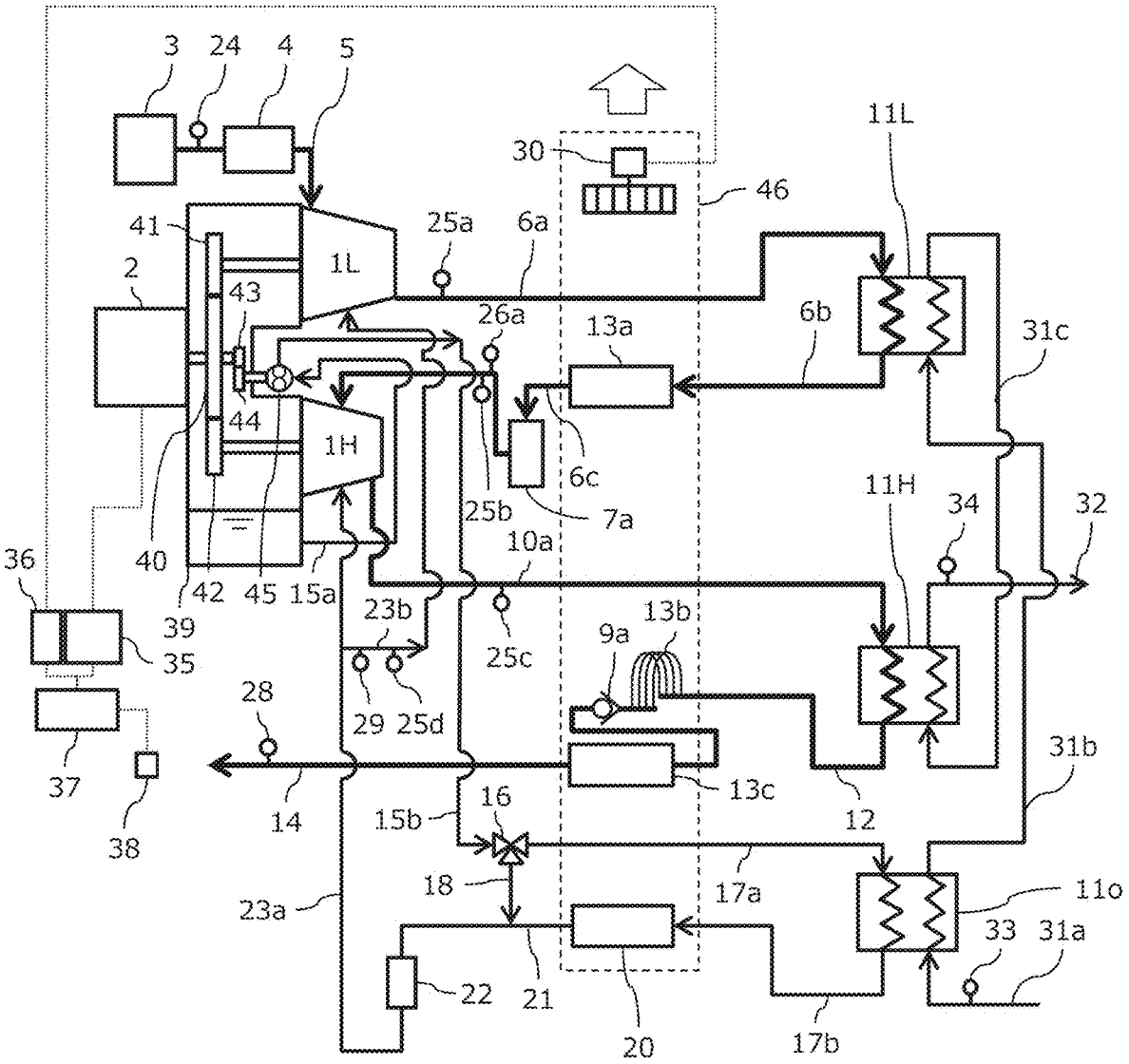
FIG. 14 is a schematic diagram illustrating a general configuration of a gas compressor according to a seventh embodiment of the present invention.

FIG. 14 is a schematic diagram illustrating a general configuration of a gas compressor according to a seventh embodiment of the present invention. The seventh embodiment will be described below mainly with respect to its differences from the fifth embodiment.

The gas compressor according to the present embodiment further includes, in addition to the configuration (FIG. 9) according to the fifth embodiment, a lubricating oil waste-heat-recovery heat exchanger 11*o* for recovering waste heat from the lubricating oil. Specifically, the temperature control valve 16 has two outlets, one of which is connected to an oil passage 17*a* on the side going through the oil cooler 20, the oil passage 17*a* being connected to a high-temperature fluid passage inlet of the lubricating oil waste-heat-recovery heat exchanger 11*o*. The lubricating oil waste-heat-recovery heat exchanger 11*o* has a high-temperature fluid passage outlet connected to an oil passage 17*b* held in fluid communication with the oil cooler 20. Details downstream of the oil cooler 20 are identical to those according to the fifth embodiment.

Water is supplied to the low-temperature fluid passages in the waste-heat-recovery heat exchangers in the following sequence: First, the water supply passage 31*a* for introducing water at a lowest water temperature from the water supply source is connected to the low-temperature fluid passage inlet in the lubricating oil waste-heat-recovery heat exchanger 11*o*, and the water is first heated by the heat of the lubricating oil. The reason why water is initially introduced into the lubricating oil waste-heat-recovery heat exchanger 11*o* is to ensure a temperature difference between the lubricating oil and the water since the lubricating oil temperature is much lower than the discharged air temperature in the high-pressure stage or the low-pressure stage in the non-oil-fed-type compressor. As with the fifth embodiment, the water that has passed through the lubricating oil waste-heat-recovery heat exchanger 11*o* flows via the water supply passage 31*b* into the low-pressure stage waste-heat-recovery heat exchanger 11L where the water is heated by the heat of the low-pressure stage discharged air, and then flows via a water supply passage 31*c* into the high-pressure stage waste-heat-recovery heat exchanger 11H where the water is heated by the high-pressure stage discharged air at even higher-temperature, after which the heated air is supplied to hot-water demanders.

According to the present embodiment, the low-temperature fluid passages in the three waste-heat-recovery heat exchangers 11*o*, 11L, and 11H are connected in series with each other. The gas compressor according to the present embodiment has its characteristic curve represented by the curve 2 illustrated in FIG. 4. However, inasmuch as the target high-pressure stage discharged air temperature TdH1*t* and the target high-pressure stage water outlet temperature TwH2*t* can be increased by recovering waste heat from the lubricating oil, the characteristic curve is actually slightly shifted to an upper right side of the curve 2 in FIG. 4.

Summary

The gas compressor according to the present embodiment includes the lubricating liquid waste-heat-recovery heat exchanger 11*o* that performs a heat exchange between the lubricating liquid discharged as a high-temperature fluid from the compressor main bodies 1L and 1H and the heat recovery liquid as a low-temperature fluid, and the lubricating liquid waste-heat-recovery heat exchanger 11*o* has a low-temperature fluid passage positioned upstream of the respective low-temperature fluid passages in the low-pressure stage waste-heat-recovery heat exchanger 11L and the high-pressure stage waste-heat-recovery heat exchanger 11H.

According to the present embodiment configured as described above, since waste heat can also be recovered from the lubricating liquid, the amount of heat that can be recovered is increased to increase a higher energy saving capability. In addition, since the heat recovery liquid that has been preheated by the lubricating liquid can be heated by the low-pressure stage discharged air and the high-pressure stage discharged air, it is possible to supply a heat recovery liquid at a temperature higher than that with the fifth embodiment.

Eighth Embodiment

Figure 15:
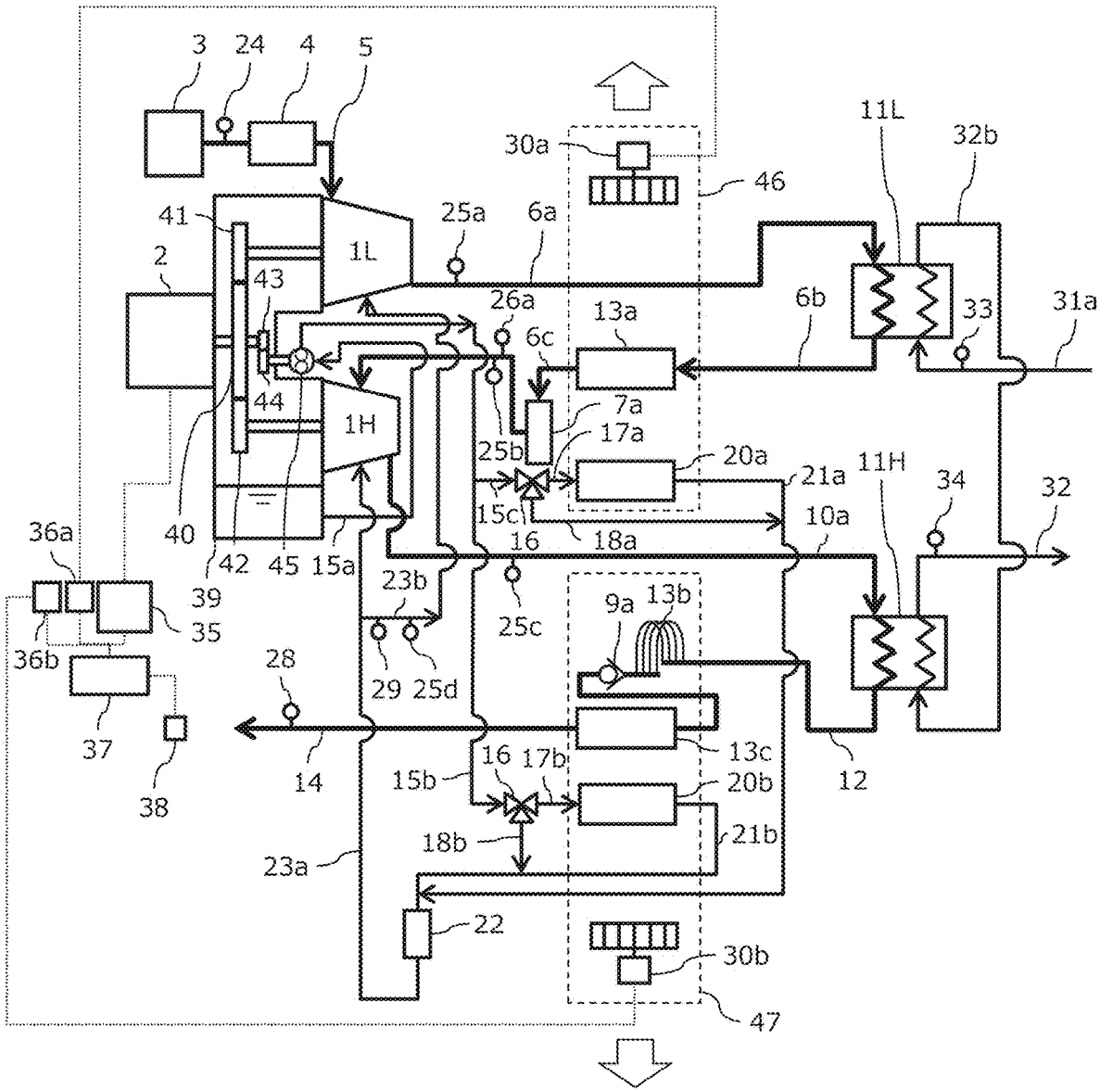
FIG. 15 is a schematic diagram illustrating a general configuration of a gas compressor according to an eighth embodiment of the present invention.

FIG. 15 is a schematic diagram illustrating a general configuration of a gas compressor according to an eighth embodiment of the present invention. The eighth embodiment will be described below mainly with respect to its differences from the fifth embodiment.

The gas compressor according to the present embodiment includes a fan duct 46 for the intercooler and a fan duct 47 for the aftercooler, with cooling fans 30*a* and 30*b* housed respectively in the fan ducts 46 and 47.

The intercooler 13*a* and an oil cooler 20*a* are disposed in the fan duct 46 that houses the cooling fan 30*a* therein or disposed in the form of being connected to openings in the fan duct 46, and these coolers cool the fluid therein with cooling air produced by the cooling fan 30*a*.

The precooler 13*b*, the aftercooler 13*c*, and an oil cooler 20*b* are disposed in the fan duct 47 that houses the cooling fan 30*b* therein or disposed in the form of being connected to openings in the fan duct 47, and these coolers cool the fluid therein with cooling air produced by the cooling fan 30*a*.

The oil cooler 20*a* is disposed downstream of the oil passage 17*a* that is disposed downstream of the temperature control valve 16 that is disposed downstream of and connected to an oil passage 15*c* that branches from the oil passage 15*b*. The lubricating oil cooled by the oil cooler 20*a* flows through an oil passage 21*a*, joins the lubricating oil in an oil passage 21*b*, and is then filtered by the oil filter 22.

The oil cooler 20*b* is disposed downstream of the oil passage 17*b* that is disposed downstream of the temperature control valve 16 disposed downstream of and connected to the oil passage 15*b*. The lubricating oil cooled by the oil cooler 20*b* flows through the oil passage 21*b*, joins the lubricating oil in the oil passage 21*a*, and is then filtered by the oil filter 22.

The cooling fan 30*a* and the cooling fan 30*b* are driven and have their rotational speeds controlled respectively by a cooling fan inverter 36*a* and a cooling fan inverter 36*b*. Operation commands and control commands are issued to the cooling fan inverter 36*a* and the cooling fan inverter 36*b* by the main control board 37.

Summary

The compressor main bodies 1L and 1H according to the present embodiment include the low-pressure stage compressor main body 1L and the high-pressure stage compressor main body 1H, the air-cooled coolers 13*a* and 13*c* include the intercooler 13*a* for cooling the compressed gas discharged from the low-pressure stage compressor main body 1L and the aftercooler 13*c* for cooling the compressed gas discharged from the high-pressure stage compressor main body 1H, and the cooling fans 30*a* and 30*b* include the first cooling fan 30*a* for delivering air to the intercooler 13*a* and the second cooling fan 30*b* for delivering air to the aftercooler 13*b*. Further, the gas compressor includes the first fan duct 46 housing the first cooling fan 30*a* and the intercooler 13*a* therein or having the opening connected to the air passage portion of the intercooler 13*a* and the second fan duct 47 housing the second cooling fan 30*b* and the aftercooler 13*c* therein or having the opening connected to the air passage portion of the aftercooler 13*c*.

According to the present embodiment configured as described above, when the hot water priority mode is effective, with leaving the second cooling fan 30*b* being operated at full speed, only the first cooling fan 30*a* is decelerated and its rotational speed is controlled. This reduces the cooling capability of the intercooler 13*a* to increase the high-pressure stage intake air temperature, to thereby increase the high-pressure side discharged air temperature TdH1, resulting in an increase in the water outlet temperature TwH2. At this time, since the second cooling fan 30*b* is operated at full speed, the cooling capability of the after cooler 13*b* is maximized to supply sufficiently cooled compressed air to compressed air demanders, reducing loads on compressed air dehumidifying apparatuses that may be installed downstream of the compressor.

Moreover, by having the cooling of the lubricating oil shared by the two oil coolers 20*a* and 20*b*, even when the first cooling fan 30*a* is operated in deceleration, the oil cooler 20*b* is able to continue cooling the lubricating oil with the second cooling fan 30*b* that is capable of operating at full speed, so that an increase in the lubricating oil temperature is kept within a certain range. Therefore, the gas compressor operates with increased reliability in environments where the ambient atmosphere is high in temperature.

While the embodiments have been described above, the present invention is not limited to the above embodiments, but covers various modifications. For example, the present invention has been described as being applied to screw compressors. However, the present invention is not limited to such compressors, but is also applicable to scroll compressors, turbo compressors, roots blowers, and the like. In the above embodiments, examples of screw compressors each having a pair of male and female screw rotors housed in a rotor chamber have been described. However, the present invention is also applicable to a single-screw compressor having a single screw rotor. In the above embodiments, water is used as a low-temperature fluid in the waste-heat-recovery heat exchanger 11, the low-pressure stage waste-heat-recovery heat exchanger 11L, and the high-pressure stage waste-heat-recovery heat exchanger 11H. However, a low-temperature fluid is not limited to water only as a coolant liquid containing an anti-freezing component such as alcohols, a solution, or oil may also be assumed to be used as a low-temperature fluid. The drive system has been illustrated as including the single main motor 2 that is directly connected to the compressor main body 1 to drive the latter. However, the main motor 2 may drive the compressor main body 1 through an accelerating gear system, a coupling, or a belt. The present invention is also applicable to a multiple-stage compressor including a plurality of compressor main bodies for compressing a gas through several stages. The low-pressure stage compressor main body and the high-pressure stage compressor main body may be driven by respective separate motors. The gas compressor may include a plurality of cooling fans and a plurality of cooling fan inverters. Of two cooling fans, one may be driven by a cooling fan inverter and the other may be driven at a constant speed based on a power supply frequency, for example.

According to the second embodiment, a plate-type heat exchanger including three systems of compressed air, lubricating oil, and water in one waste-heat-recovery heat exchanger has been assumed. However, two kinds of heat exchangers may be used to perform a heat exchange between compressed air and water and a heat exchange between lubricating oil and water. In all of the embodiments, each heat exchanger may be a shell-and-tube heat exchanger. The high-temperature fluid side and the low-temperature fluid side may not be connected in the sequence illustrated in each of the embodiments, but may be connected in a different sequence in each of the embodiments. For example, while the high-temperature fluid and the low-temperature fluid are illustrated as flowing in a counterflow configuration in each of the waste-heat-recovery heat exchangers, they may be arranged to flow in a parallel-flow configuration.

The above embodiments have been described in detail for an easier understanding of the invention, and the present invention should not be limited to anything that includes all of the constituent elements described above. For example, some of the constituent elements of a certain embodiment may be replaced with constituent elements of another embodiment or other embodiments, and constituent elements of a certain embodiment may be added to constituent elements of another embodiment or other embodiments. Moreover, some of the constituent elements of each of the embodiments may be deleted, or may be added to or replaced with constituent elements of another embodiment or other embodiments.

DESCRIPTION OF REFERENCE CHARACTERS

1: Compressor main body
1L: Low-pressure stage compressor main body
1H: High-pressure stage compressor main body
2: Main motor
3: Intake filter
4: Intake valve
5: Intake passage
6, 6*a*, 6*b*, 6*c*, 10, 10*a*, 12, 14: Discharged air passage
7: Primary oil separator
7*a*: Condensed water separator
8: Secondary oil separator
9: Pressure-regulating check valve
10, 10*a*: Discharged air passage
11, 11A: Waste-heat-recovery heat exchanger
11L: Low-pressure stage waste-heat-recovery heat exchanger
11H: High-pressure stage waste-heat-recovery heat exchanger
11*o*: Lubricating oil waste-heat-recovery heat exchanger (lubricating liquid waste-heat-recovery heat exchanger)
13*a*: Intercooler (air-cooled cooler)
13*b*: Precooler (air-cooled cooler)
13*c*: Aftercooler (air-cooled cooler)
15, 15*a*, 15*b*, 15*c*, 17, 17*a*, 17*b*, 19, 21, 21*a*, 21*b*, 23, 23*a*: Oil passage
16: Temperature control valve
18, 18*a*, 18*b*: Oil bypass passage
20, 20*a*, 20*b*: Oil cooler (air-cooled cooler)
22: Oil filter
24: Intake pressure sensor
25: Discharged air temperature sensor (discharged gas temperature sensor)
25*a*: Low-pressure stage discharged air temperature sensor
25*b*: High-pressure stage intake air temperature sensor
25*c*: High-pressure stage discharged air temperature sensor
26: Discharged air pressure sensor
26*a*: High-pressure stage intake air pressure sensor
27: Lubricating oil inlet temperature sensor
28: Unit outlet discharged air pressure sensor
29: Supplied oil pressure sensor
30: Cooling fan
30*a*: Cooling fan (first cooling fan)
30*b*: Cooling fan (second cooling fan)
31, 31*a*, 31*b*, 31*c*, 32: Water supply passage
33: Water inlet temperature sensor
34: Water outlet temperature sensor (heat exchange liquid temperature sensor)
35: Main motor inverter
36, 36*a*, 36*b*: Cooling fan inverter
37: Main control board (controller)
38: Input and display device (switching indicating device)
39: Gear case
45: Oil pump
46: Fan duct (first fan duct)
47: Fan duct (second fan duct)
48: Oil separator outlet air temperature sensor
Td1: Discharged air temperature (discharged gas temperature)
Td1*t*: Target discharged air temperature (target discharged gas temperature)
TdL1: Low-pressure stage discharged air temperature (low-pressure stage high-temperature fluid inlet temperature)
TdH1: High-pressure stage discharged air temperature (high-pressure stage high-temperature fluid inlet temperature)
Td1*t*: Target discharged air temperature
TdH1*t*: Target high-pressure stage discharged air temperature
Td1*f*: Fan-control-start discharged air temperature
TdH1*f*: Fan-control-start high-pressure stage discharged air temperature
Td1A: Discharged air alarm temperature
TdH1A: High-pressure stage discharged air alarm temperature
Td1*r*: Hot-water-priority-mode discharged air upper-limit temperature
TdH1*r*: Hot-water-priority-mode high-pressure stage discharged air upper-limit temperature
Tdsp: Oil separator outlet air temperature
Tw1: Water inlet temperature
TwL1: Low-pressure stage water inlet temperature
Tw2: Water outlet temperature (heat exchange liquid temperature)
TwH2: High-pressure stage water outlet temperature
Tw2*t*: Target water outlet temperature (target heat exchange liquid temperature)
TwH2*t*: Target high-pressure stage water outlet temperature
ΔTm: Logarithmic average temperature difference ΔTmL: Low-pressure stage logarithmic average temperature difference ΔTmH: High-pressure stage logarithmic average temperature difference Ps: Intake pressure Pd: Unit outlet discharged air pressure PsH: High-pressure stage intake air pressure Po: Oil supply pressure Ff: Cooling fan inverter output frequency Ffmax: Cooling fan inverter maximum output frequency

The invention claimed is:

1. A gas compressor comprising:

a compressor main body for sucking in a gas, compressing the sucked gas, and discharging the compressed gas;

a waste-heat-recovery heat exchanger for performing a heat exchange between at least part of a high-temperature fluid discharged from the compressor main body and a heat exchange liquid as a low-temperature fluid;

an air-cooled cooler for cooling the high-temperature fluid;

a cooling fan for delivering air to the air-cooled cooler;

a controller for controlling a rotational speed of the cooling fan; and a discharged gas temperature sensor for detecting a discharged gas temperature representing a temperature of the compressed gas discharged from the compressor main body, wherein the gas compressor includes;

a heat exchange liquid temperature sensor for detecting a temperature of the heat exchange liquid discharged from the waste-heat-recovery heat exchanger, and a passage that allows at least part of the high-temperature fluid cooled by the air-cooled cooler to flow therethrough into the compressor main body, and the controller has a heat recovery liquid temperature adjusting function to control the rotational speed of the cooling fan such that the temperature detected by the heat exchange liquid temperature sensor gets closer to a predetermined target heat exchange liquid temperature, and wherein the controller is configured to:

store a correlative relationship between the temperature of the heat exchange liquid discharged from the waste-heat-recovery heat exchanger and the temperature of the compressed gas discharged from the compressor main body, set the temperature of the discharged gas that corresponds to the temperature of the heat exchange liquid, the temperature coinciding with the target heat exchange liquid temperature, as a target discharged gas temperature in the correlative relationship, and control the rotational speed of the cooling fan such that the temperature detected by the discharged gas temperature sensor gets closer to the target discharged gas temperature.

2. The gas compressor according to claim 1, wherein the gas compressor includes a switching indicating device for indicating whether the heat recovery liquid temperature adjusting function is to be made effective or ineffective, and wherein the controller is configured to:

control the rotational speed of the cooling fan such that the temperature detected by the heat exchange liquid temperature sensor gets closer to a predetermined target heat exchange liquid temperature when the switching indicating device indicates that the heat recovery liquid temperature adjusting function is to be made effective, and control the rotational speed of the cooling fan such that the discharged gas temperature gets closer to the target discharged gas temperature when the switching indicating device indicates that the heat recovery liquid temperature adjusting function is to be made ineffective.

3. The gas compressor according to claim 1, wherein the compressor main body is of a liquid-fed type in which a lubricating liquid is injected into a working chamber defined therein, and wherein the high-temperature fluid that flows into the waste-heat-recovery heat exchanger includes the lubricating liquid discharged from the compressor main body.

4. The gas compressor according to claim 1, wherein the compressor main body is of a non-liquid-fed type in which a cooling liquid or a lubricating liquid is not injected into a working chamber defined therein, and wherein the high-temperature fluid that flows into the waste-heat-recovery heat exchanger includes the compressed gas discharged from the compressor main body.

5. The gas compressor according to claim 1, wherein the compressor main body is of a multiple-stage type.

6. The gas compressor according to claim 5, wherein the compressor main body includes a low-pressure stage compressor main body and a high-pressure stage compressor main body, wherein the waste-heat-recovery heat exchanger includes a low-pressure stage waste-heat-recovery heat exchanger that performs a heat exchange between the compressed gas discharged as the high-temperature fluid from the low-pressure stage compressor main body and a heat recovery liquid as the low-temperature fluid, and a high-pressure stage waste-heat-recovery heat exchanger that performs a heat exchange between the compressed gas discharged as the high-temperature fluid from the high-pressure stage compressor main body and the heat recovery liquid as the low-temperature fluid, and wherein the low-pressure stage waste-heat-recovery heat exchanger and the high-pressure stage waste-heat-recovery heat exchanger have respective low-temperature fluid passages connected in series with each other.

7. The gas compressor according to claim 6, wherein the gas compressor includes a lubricating liquid waste-heat-recovery heat exchanger that performs a heat exchange between a lubricating liquid discharged as the high-temperature fluid from the compressor main body and the heat recovery liquid as the low-temperature fluid, and wherein the lubricating liquid waste-heat-recovery heat exchanger has a low-temperature fluid passage positioned upstream of the respective low-temperature fluid passages of the low-pressure stage waste-heat-recovery heat exchanger and the high-pressure stage waste-heat-recovery heat exchanger.

8. The gas compressor according to claim 5, wherein the compressor main body includes a low-pressure stage compressor main body and a high-pressure stage compressor main body, wherein the waste-heat-recovery heat exchanger includes a low-pressure stage waste-heat-recovery heat exchanger that performs a heat exchange between the compressed gas discharged as the high-temperature fluid from the low-pressure stage compressor main body and a heat recovery liquid as the low-temperature fluid, and a high-pressure stage waste-heat-recovery heat exchanger that performs a heat exchange between the compressed gas as the high-temperature fluid discharged from the high-pressure stage compressor main body and the heat recovery liquid as the low-temperature fluid, and wherein the low-pressure stage waste-heat-recovery heat exchanger and the high-pressure stage waste-heat-recovery heat exchanger have respective low-temperature fluid passages connected parallel to each other.

9. The gas compressor according to claim 5, wherein the compressor main body includes a low-pressure stage compressor main body and a high-pressure stage compressor main body, wherein the air-cooled cooler includes an intercooler for cooling the compressed gas discharged from the low-pressure stage compressor main body and an aftercooler for cooling the compressed gas discharged from the high-pressure stage compressor main body, wherein the cooling fan includes a first cooling fan for delivering air to the intercooler and a second cooling fan for delivering air to the aftercooler, and wherein the gas compressor includes:

a first fan duct housing the first cooling fan and the intercooler therein or having an opening connected to an air passage portion of the intercooler, and a second fan duct housing the second cooling fan and the aftercooler therein or having an opening connected to an air passage portion of the aftercooler.

* * * * *